US011598091B2

(12) United States Patent
Mirkhani et al.

(10) Patent No.: US 11,598,091 B2
(45) **Date of Patent: *Mar. 7, 2023**

(54) SLAB FILLERS AND METHODS FOR IMPLEMENTING FILLERS IN TWO-WAY CONCRETE SLABS FOR BUILDING STRUCTURES

(71) Applicants: Seyed Soroush Mirkhani, Tehran (IR); Ali Firouzi Monfared, Tehran (IR)

(72) Inventors: Seyed Soroush Mirkhani, Tehran (IR); Ali Firouzi Monfared, Tehran (IR)

( * ) Notice: Subject to any disclaimer, the term of this patent is extended or adjusted under 35 U.S.C. 154(b) by 0 days.

This patent is subject to a terminal disclaimer.

(21) Appl. No.: 16/923,462

(22) Filed: Jul. 8, 2020

(65) Prior Publication Data

US 2021/0317659 A1 Oct. 14, 2021

Related U.S. Application Data

(62) Division of application No. 15/573,478, filed on Nov. 12, 2017, now Pat. No. 10,753,088.

(51) Int. Cl.

| | |
|---|---|
| ***E04B 7/00*** | (2006.01) |
| ***E04C 5/20*** | (2006.01) |
| ***E04B 5/32*** | (2006.01) |
| ***E04B 1/16*** | (2006.01) |
| *E04B 5/21* | (2006.01) |
| *E02D 5/10* | (2006.01) |
| *E02D 5/34* | (2006.01) |
| *E02D 5/12* | (2006.01) |

(52) U.S. Cl.

CPC ..... *E04B 7/00* (2013.01); *E04B 1/16* (2013.01); *E04B 5/326* (2013.01); *E04C 5/20* (2013.01); *E02D 5/10* (2013.01); *E02D 5/12* (2013.01); *E02D 5/34* (2013.01); *E04B 5/21* (2013.01); *E04B 2103/02* (2013.01)

(58) Field of Classification Search

CPC ... E04B 7/00; E04B 5/326; E04B 1/16; E04B 5/21; E04B 2103/02; E04C 5/20

See application file for complete search history.

(56) References Cited

U.S. PATENT DOCUMENTS 3,789,094 A * 1/1974 Hutchison ..... B29C 44/1266 428/116
3,908,323 A * 9/1975 Stout ..... E04B 5/48 52/99
3,922,413 A * 11/1975 Reineman ..... E04C 2/36 52/576

(Continued)

*Primary Examiner* — Phi D A

(57) ABSTRACT

A slab filler, and method for implementing fillers in a two-way concrete slab for building structures, are disclosed. The filler comprises an upper keeper tray and a lower keeper tray, and a volumetric filling element. The upper keeper tray is attached to a top of the volumetric filling element and the lower keeper tray is attached to a bottom of the volumetric filling element. The filler comprises a plurality of indicators positioned on all corners of the keeper tray to indicate an amount or level of a concrete fed on the filler. The filler further comprises grooves at an end of the spacer, configured to securely hold one or more belts. Spacers and belts are configured to receive one or more rebar. Further, the volumetric filling element is a high-density material, where the filler is incorporated without upper keeper tray and lower keeper tray.

19 Claims, 47 Drawing Sheets

(56) References Cited

U.S. PATENT DOCUMENTS

| | | | | | |
|---|---|---|---|---|---|
| 4,116,415 | A * | 9/1978 | Ward | E04G 11/10 | 249/188 |
| 4,164,831 | A * | 8/1979 | Messick | E04C 2/044 | 52/612 |
| 4,213,281 | A * | 7/1980 | Zarzosa-Castilla | E04B 5/265 | 52/333 |
| 4,663,909 | A * | 5/1987 | Ogino | E04D 11/005 | 52/263 |
| 4,803,108 | A * | 2/1989 | Leuchten | B32B 3/12 | 428/118 |
| 5,421,136 | A * | 6/1995 | Van De Peer | E02D 27/08 | 52/294 |
| 6,581,352 | B1 * | 6/2003 | Amirsoleymani | E04C 2/382 | 52/405.3 |
| 6,789,366 | B1 * | 9/2004 | Febra | B28B 23/0068 | 52/576 |
| 7,596,918 | B2 * | 10/2009 | Hills | E04G 15/061 | 52/340 |
| 7,784,235 | B2 * | 8/2010 | Cretti | E04C 5/065 | 52/332 |
| 8,028,485 | B2 * | 10/2011 | Pfeffer | E04C 5/0622 | 52/576 |
| 8,657,984 | B1 * | 2/2014 | Williams | B29D 99/0014 | 156/245 |
| 8,943,771 | B2 * | 2/2015 | Garcia | E04B 5/14 | 52/33 |
| 8,955,278 | B1 * | 2/2015 | Mills | F24F 13/222 | 52/302.3 |
| 8,966,855 | B1 * | 3/2015 | Miller | E04B 5/10 | 52/650.3 |
| 10,286,626 | B2 * | 5/2019 | Parsons | B32B 3/28 | |
| 2005/0224690 | A1 * | 10/2005 | Hobbs | E04F 15/12 | 52/302.1 |

* cited by examiner

SLAB FILLERS AND METHODS FOR IMPLEMENTING FILLERS IN TWO-WAY CONCRETE SLABS FOR BUILDING STRUCTURES

CROSS-REFERENCE TO RELATED APPLICATIONS

This application is a divisional of U.S. patent application Ser. No. 15/573,478, filed Nov. 12, 2017, which claims priority to International Patent Application No. PCT/IB2016/053384, filed Jun. 9, 2016, the disclosures of which are incorporated by reference herein.

BACKGROUND OF THE INVENTION

Generally, concrete and steel were used together to construct reinforced cement concrete (RCC) slab, which have individual properties, as separate building materials and possess certain individual limitations. Plain concrete may have compressive strength, i.e., its ability to resist crushing loads; however, its tensile strength may be only about 10% of its compressive strength. Its tensile strength may be so low that it may be disregarded in design of some concrete structures. Reinforced concrete may be a combination of adequate reinforcement (such as steel bars) and concrete designed to work together to resist applied loads.

The filler slab is based on the principle that for roofs which are simply supported, the upper part of the slab is subjected to compressive forces and the lower part of the slab experience tensile forces. Concrete is very good in withstanding compressive forces and steel bears the load due to tensile forces. Henceforth, the lower tensile region of the slab does not need much concrete except for holding the steel reinforcements together.

In conventional RCC slab, a lot of concrete is wasted, and it requires extra reinforcement due to added load of the concrete. There remains a need in the art to find new and improved ways to reduce the dead weight and cost of the slab and related components. The problems of existing technology are numerous and include a lack of sufficient web shear resistance, impossibility of optimizing voiding elements' size, breakage, and deformation of plastic parts etc., all of which impair some technical features of slabs and are associated with difficulty of usage. The present disclosure provides an improved technology and overcomes at least some of these limitations.

SUMMARY OF THE INVENTION

The present invention relates to a slab filler and method for implementing fillers in a two-way concrete slab for building structures. In an embodiment, a filler for use in a two-way concrete slab for building structures is disclosed. In one embodiment, the filler comprises an upper keeper tray and a lower keeper tray, and a volumetric filling element arranged in between the upper keeper tray and the lower keeper tray. In one embodiment, the upper keeper tray is attached to a top of the volumetric filling element and the lower keeper tray is attached to a bottom of the volumetric filling element. In another embodiment, the volumetric filling element is a high-density material, where the filler for use in a two-way concrete slab is incorporated without upper keeper tray and lower keeper tray. In some embodiments, the volumetric filling element is made of a light-weight material. In one embodiment, the volumetric filling element is carved to enable adjustable geometrical structure and size of the filler.

In one embodiment, the light-weight material is selected from a group comprising any one of polystyrene, polyurethane, polyethylene, concrete foam clay, gas concrete, autoclaved aerated concrete (AAC), or any combination thereof. In some embodiments, the light-weight material is a sound insulator, heat insulator, or both. In one embodiment, the volumetric filling element is a cubic-shaped element with one or more chamfer edges. In one embodiment, the cubic-shaped element with one or more chamfer edges is configured to prevent concrete honeycombing at the bottom surface of the slabs. In an embodiment, the cubic-shaped element with one or more chamfer edges further enables haunch connection in a junction between a web and a flange. In one embodiment, the haunch connection is configured to increase section modulus of one or more joists formed between the volumetric filling elements. In one embodiment, the joist comprises one or more stirrups and steel wires. The stirrups and steel wires fastens the upper keeper tray and the lower keeper tray to encompass the volumetric filling element to resist buoyancy force of the feeding concrete. In another embodiment, the haunch connection is further configured to reduce stress concentration in the junction between web and flange.

In one embodiment of the present invention, the upper keeper tray and the lower keeper tray are fasten or welded via one or more stirrups to a rebar. The rebar is configured to form coop or hutch around the volumetric filling element. The rebar is further configured to maintain predetermined distance between the volumetric filling elements to resist shear force and moments in the slab. In one embodiment, the upper keeper tray and lower keeper tray is made of plastic, wood or steel. In some embodiments, the volumetric filling element is one of geometric shape including cube, cylinder, sphere, truncated pyramid and combination thereof.

In one embodiment, the keeper tray is configured to distribute load on the volumetric filling element. In another embodiment, the keeper tray is further configured to securely hold the volumetric filling element. In some embodiments, the keeper tray comprises one or more ridges. In one embodiment of the present invention, the filler for use in a two-way concrete slab further comprises one or more spacers positioned on the keeper tray. In one embodiment, the filler further comprises one or more grooves at an end of the spacer, configured to securely hold one or more belts. In one embodiment, the filler further comprises at least one belt configured to attach at least one upper keeper tray, lower keeper tray, or both. In one embodiment, the belt is configured to connect a filler to an adjacent filler of the concrete slab, and support at least partial load exerted by a rebar of the concrete slab.

In one embodiment, the belt is configured to securely hold both upper keeper tray and lower keeper tray of all the volumetric filling element via a fastening means. In some embodiments, the incorporation of the belt on the keeper tray depends on shape and location of the keeper tray and belt, and number of ridges and grooves in the keeper tray and belt. In one embodiment, the belt is configured to limit one or more movement of at least two volumetric filling elements. In another embodiment, the linear ridges on the keeper tray and grooves on the belts to limit one or movement of at least two volumetric filling elements. In some embodiments, the movement is horizontal, vertical or rotational movement. In one embodiment, the belt is further configured to position the rebar between the volumetric filling elements.

In one embodiment, the filler further comprises a plurality of indicators positioned in all corners or at least one corner of the keeper tray supported via one or more buttress. In another embodiment, the indicator is configured to indicate an amount or level of a concrete fed on the filler. In one embodiment, the indicator is configured to indicate thickness of the concrete fed on the voided volumetric filling element. In one embodiment, the indicator is positioned on the upper keeper tray to indicate the status of concrete thickness fed on the voided volumetric filling element. In some embodiments, the indicator is a plurality of installable legs with pre-determined length mounted below the lower keeper tray to allow concrete to reach under the lower keeper tray while feeding the concrete. In some embodiments, the plurality of installable legs is variable in length.

In one embodiment, the at least one keeper tray further comprises one or more nail-shaped appendices. The nail-shaped appendices are configured to attach at least one keeper tray to the volumetric filling element via an adhesive. In one embodiment, the spacer and belt in the keeper tray is configured to receive one or more rebar. In some embodiments, the belt comprises one or more linear grooves. In another embodiment, the belt further comprises one or more additional ridges on a wall of the belt to lock the grooves in the keeper tray. In one embodiment, the belt is configured to connect one or more volumetric filling elements. In one embodiment, the spacer is a continuous fabric spacer. In various embodiments, the keeper tray is embodied with the fabric spacer of different configuration. Further, the spacer is detachably fixed to the keeper tray in different configuration.

In an embodiment, the volumetric filling element further includes one or more exhaust holes to allow exit of the trapped air. In one embodiment, the rebar is configured to assemble based on different configuration of the keeper tray. In some embodiments, the belt is made of different shape and configuration.

In an embodiment, a method for implementing fillers in a two-way concrete slab for building structures is disclosed. In one step, the method comprises providing an upper keeper tray and a lower keeper tray with one or more spacers positioned on the keeper tray. In another step, the method comprises providing a plurality of indicators positioned in all corners or at least one corner of the keeper tray supported via one or more buttress to indicate an amount or level of a concrete fed on the filler. In another step, the method further includes providing one or more grooves at an end of the spacer, configured to securely hold one or more belts. The spacer and belt in the keeper tray is configured to receive one or more rebar, said at least one belt is configured to attach at least one upper keeper tray, lower keeper tray, or both. In another step, the method further includes arranging a volumetric filling element in between the upper keeper tray and the lower keeper tray. In final step, the method comprises attaching the upper keeper tray to a top of the volumetric filling element and the lower keeper tray to a bottom of the volumetric filling element, thereby forming a filler in a two-way concrete slab for building structures.

One aspect of the present disclosure is directed to a filler for use in a two-way concrete slab for building structures, the filler comprising: (a) an upper keeper tray and a lower keeper tray with one or more spacers positioned on said keeper tray; (b) a plurality of indicators positioned in all corners or at least one corner of the keeper tray supported via one or more buttress to indicate an amount or level of a concrete fed on the filler; (c) one or more grooves at an end of the spacer, configured to securely hold one or more belts, wherein the spacer and belt in the keeper tray is configured to receive one or more rebar, said at least one belt is configured to attach at least one upper keeper tray, lower keeper tray, or both; and (d) a volumetric filling element arranged in between the upper keeper tray and the lower keeper tray, wherein the upper keeper tray is attached to a top of the volumetric filling element and the lower keeper tray is attached to a bottom of the volumetric filling element.

In one embodiment, the volumetric filling element is a high-density material, wherein the said volumetric filling material is incorporated without upper keeper tray and lower keeper tray. In another embodiment, the volumetric filling element is made of a light-weight material, wherein the volumetric filling element is carved to enable adjustable geometrical structure and size of the filler. In a related embodiment, the light-weight material is selected from a group comprising any one of polystyrene, polyurethane, polyethylene, concrete foam clay, gas concrete, autoclaved aerated concrete (AAC), or any combination thereof. In another related embodiment, the light-weight material is a sound insulator, heat insulator, or both.

In one embodiment, the volumetric filling element is a cubic-shaped element with one or more chamfer edges. In one embodiment, the cubic-shaped element with one or more chamfer edges enables haunch connection in a junction between a web and a flange. In one embodiment, the haunch connection is configured to increase section modulus of one or more joists formed between the volumetric filling elements. In one embodiment, the haunch connection is further configured to reduce stress concentration in the junction between the web and flange. In a related embodiment, the joist comprises one or more stirrups and steel wires, wherein said stirrups and steel wires fastens the upper keeper tray and the lower keeper tray to encompass the volumetric filling element to resist buoyancy force of the feeding concrete.

In one embodiment, the upper keeper tray and the lower keeper tray are fasten or welded via one or more stirrups to a rebar. In one embodiment, the rebar is configured to form coop or hutch around the volumetric filling element. In one embodiment, the rebar is configured to resist shear force and moments on the concrete slab. In one embodiment, the upper keeper tray and lower keeper tray is made of plastic, wood or steel. In one embodiment, the volumetric filling element is one of geometric shape including cube, cylinder, sphere, truncated pyramid and combination thereof. In one embodiment, the keeper tray is configured to distribute load on the volumetric filling element. In one embodiment, the keeper tray is further configured to securely hold the volumetric filling element. In one embodiment, the keeper tray comprises one or more ridges. In one embodiment, the filler further comprises one or more spacers positioned around the keeper tray.

In another embodiment, the filler further comprises one or more grooves at an end of the spacer, configured to securely hold one or more belts. In one embodiment, the belt is configured to: connect a filler to an adjacent filler of the concrete slab, and support at least partial load exerted by the rebar of the concrete slab. In another embodiment, the belt is configured to securely hold both upper keeper tray and lower keeper tray of all the volumetric filling elements via a fastening means. In one embodiment, the belt is incorporated on the keeper tray depends on shape and location of the keeper tray and belt, and number of ridges and grooves in the keeper tray and belt. In one embodiment, the belt is configured to limit one or more movement of at least two volumetric filling elements. In one embodiment, the belt is further configured to position the rebar between the volumetric filling elements.

In one embodiment, the indicator is configured to indicate thickness of the concrete fed on the voided volumetric filling element. In one embodiment, the indicator is positioned on the upper keeper tray to indicate the status of concrete thickness fed on the voided volumetric filling element. In a related embodiment, the indicator is a plurality of installable legs with pre-determined length mounted on the lower keeper tray to allow concrete to reach under the lower keeper tray while feeding the concrete.

In one embodiment, the at least one keeper tray further comprises one or more nail-shaped appendices. In a related embodiment, the nail-shaped appendices are configured to attach at least one keeper tray to the volumetric filling element via an adhesive. In one embodiment, the belt comprises one or more linear grooves. In another embodiment, the belt comprises one or more additional ridges on a wall of the belt to lock the grooves in the keeper tray. In one embodiment, the belt is configured to connect one or more volumetric filling elements. In another embodiment, the spacer is a continuous fabric spacer. In another embodiment, the volumetric filling element further includes one or more exhaust holes to allow exit of the trapped air.

Another aspect of the present disclosure is directed to a filler for use in a two-way concrete slab for building structures, the filler comprising: (a) an upper keeper tray and a lower keeper tray; and (b) a volumetric filling element arranged in between the upper keeper tray and the lower keeper tray, wherein the upper keeper tray is attached to a top of the volumetric filling element and the lower keeper tray is attached to a bottom of the volumetric filling element, and wherein the volumetric filling element is made of a light-weight material, wherein the volumetric filling element is carved to enable adjustable geometrical structure and size of the filler.

Another aspect of the present disclosure is directed to a filler for use in a two-way concrete slab for building structures, the filler comprising: a plurality of volumetric filling element, wherein the volumetric filling element is a high-density material and embodied with a continuous fabric spacer, and wherein the volumetric filling element is incorporated without the upper keeper tray and the lower keeper tray.

Another aspect of the present disclosure is directed to a method for implementing fillers in a two-way concrete slab for building structures. The method comprises: (a) providing an upper keeper tray and a lower keeper tray with one or more spacers positioned on the keeper tray; (b) providing a plurality of indicators positioned in all corners or at least one corner of the keeper tray supported via one or more buttress to indicate an amount or level of a concrete fed on the filler; (c) providing one or more grooves at an end of the spacer, configured to securely hold one or more belts, wherein the spacer and belt in the keeper tray is configured to receive one or more rebar, said at least one belt is configured to attach at least one upper keeper tray, lower keeper tray, or both; (d) arranging a volumetric filling element in between the upper keeper tray and the lower keeper tray, and (e) attaching the upper keeper tray to a top of the volumetric filling element and the lower keeper tray to a bottom of the volumetric filling element, thereby forming a filler in a two-way concrete slab for building structures.

In one embodiment of the method, the volumetric filling element is a high-density material, wherein the said volumetric filling material is incorporated without upper keeper tray and lower keeper tray. In another embodiment of the method, the volumetric filling element is made of a light-weight material, wherein the volumetric filling element is carved to enable adjustable geometrical structure and size of the filler. In a related embodiment, the light-weight material is selected from a group comprising any one of polystyrene, polyurethane, polyethylene, concrete foam clay, gas concrete, autoclaved aerated concrete (AAC), or any combination thereof. In another embodiment, the light-weight material is a sound insulator, heat insulator, or both. In one embodiment of the method, the cubic-shaped element with one or more chamfer edges enables haunch connection in a junction between a web and a flange. In another embodiment, the haunch connection is configured to increase section modulus of one or more joists formed between the volumetric filling elements. In one embodiment, the haunch connection is further configured to reduce stress concentration in the junction between web and flange. In a related embodiment, the joist comprises one or more stirrups and steel wires, wherein said stirrups and steel wires fastens the upper keeper tray and the lower keeper tray to encompass the volumetric filling element to resist buoyancy force of the feeding concrete.

In one embodiment, at least one of upper keeper tray and lower keeper tray comprises an external plate spacer, configured to attach the filler and reinforce the filler against fracture, punching, tumbling and rupture. In another embodiment, the filler is attached to the external plate spacer by a compatible glue and nail shaped appendixes. In a related embodiment, the fillers and external plate spacers are protected and attached by packing with shrinking flexible nylon or stretch film. In another embodiment, the filler is attached to the external plate spacer using a combination of DM5 glue with water and wallpaper adhesive powder. In another embodiment, the filler is attached to the external plate spacer using a combination of DM5 glue with water and wallpaper adhesive powder at a ratio of 48% Water, 47% DM5 and 5% wallpaper adhesive powder. This exact ratio of these three components was surprisingly found to provide superior functional qualities with the advantage of it being more economical and practical. Interestingly, the same three components mixed at different ratios provided less than optimal results. Applicants were first able to discover this particular combination of three elements that would provide for great functional quality at low cost and moreover it was discovered that the particular ratio of about 47% DM5, about 48% Water, and about 5% wallpaper adhesive powder was, in one embodiment, a feature of the present invention.

In one embodiment, the method further includes embedding one or more holes in the length of the surrounded spacer for concrete entry in order to prevent the creation of hollow spaces under surrounding spacer and to prevent the weakening of the top slab. In one embodiment, these one or more holes are configured to allow the entry of concrete under the spacers that are on the trays, such that any space or void that is under the spacer is filled with concrete and air pockets underneath the spacer are minimized, thereby improving strength and integrity. In another embodiment, the method further comprising embedding one or more holes on the spacers, wherein said holes are configured to allow the entry of concrete through the holes to under the spacers that are on the trays, such that voids or air pockets under the spacers are generally filled with concrete, thereby improving strength and integrity. In one embodiment, the filler is attached to the external plate spacer using nail shaped appendixes.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DETAILED DESCRIPTION

A description of embodiments of the present invention will now be given with reference to the figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The present invention generally relates to a slab filler, and more particularly relates to a slab filler and method for implementing fillers in a two-way concrete slab for building structures, bridge and foundation.

Waffle Slabs with non-permanent fillers can be mentioned as former technical systems. In this system, due to non-permanent filler, design strips were orthogonal "T" shaped ribbed slabs which carries load in two directions. The bottom surface of these slabs become voided after pouring concrete due to removing formworks, that needs installation of false ceiling in addition to difficulties in operation. But, these kind of waffle slabs with invented permanent filler not only will have complete flat underside surface after removing of forms due to permanent filler in concrete but also due to conversion of ribbed slab section from "T" shaped to I shaped (because of concrete entry under the filler), have higher stiffness than old waffle slabs.

Figure 1A:
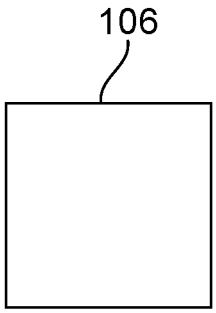
FIG. 1A-FIG. 1F illustrates top view of the various shapes volumetric filling element in the filler according to an embodiment.
Figure 1B:
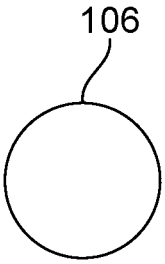
Figure 1C:
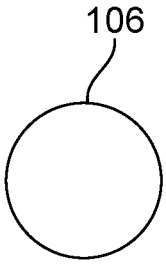
Figure 1D:
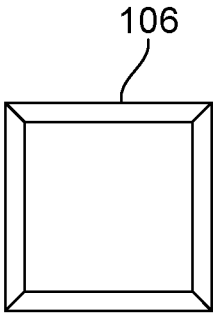
Figure 1E:
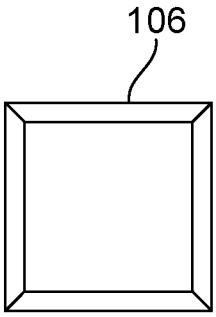
Figure 1F:
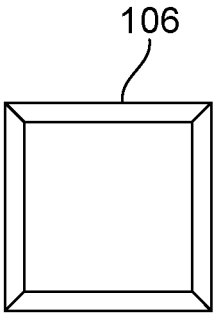
Figure 1G:
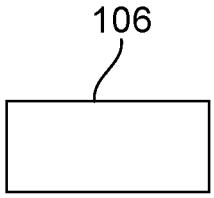
FIG. 1G-FIG. 1L illustrates a side view of the various shapes volumetric filling element in the filler according to an embodiment.
Figure 1H:
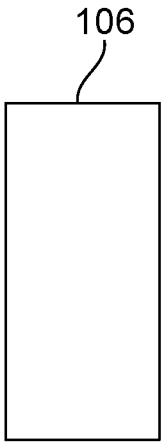
Figure 1I:
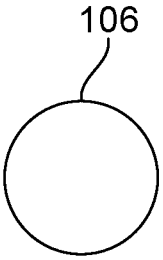
Figure 1J:
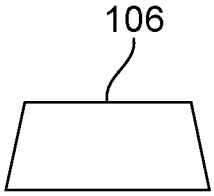
Figure 1K:
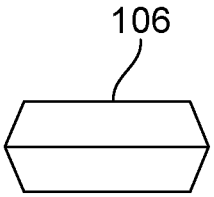
Figure 1L:
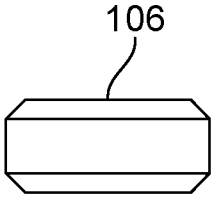
Figure 1M:
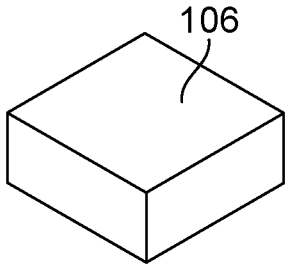
FIG. 1M-FIG. 1R shows a perspective view of the various shapes volumetric filling element in the filler according to an embodiment.
Figure 1N:
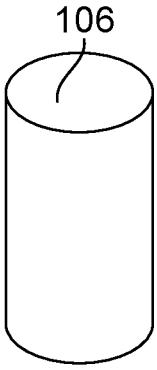
Figure 1O:
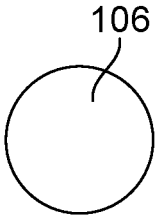
Figure 1P:
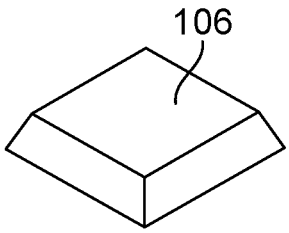
Figure 1Q:
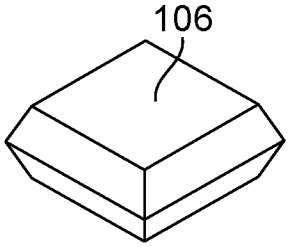
Figure 1R:
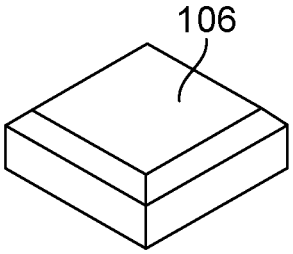

According to various embodiment of the present invention, a slab filler 100 for use in a two-way concrete slab for building structures is disclosed, referring to all the figures. In one embodiment, the filler 100 comprises an upper keeper tray 102 and a lower keeper tray 104, and a volumetric filling element 106 arranged in between the upper keeper tray 102 and the lower keeper tray 104. Referring to FIG. 1A-FIG. 1R, top view, side view and perspective view of the various shapes of volumetric filling element 106 in the filler 100 are illustrated. In some embodiments, the volumetric filling element 106 in the filler 100 could be incorporated in different shapes such as cube, cylinder, sphere, truncated pyramid, or a combination thereof. In one embodiment, the volumetric filling element 106 in the filler 100 is in predetermined dimension, thickness and shape. Predetermined dimension of the volumetric filling element 106 is done by optimizing the filler length and width based on the quantity and span of load applied on it. Predetermined thickness of the filler 100 is calculated and maintained to avoid slab deformation.

Figure 2A:
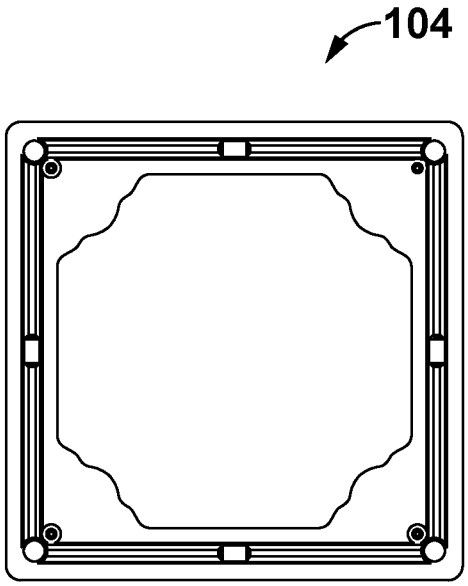
FIG. 2A and FIG. 2B illustrates a top view of the various configuration and shapes of keeper tray according to an embodiment.
Figure 2B:
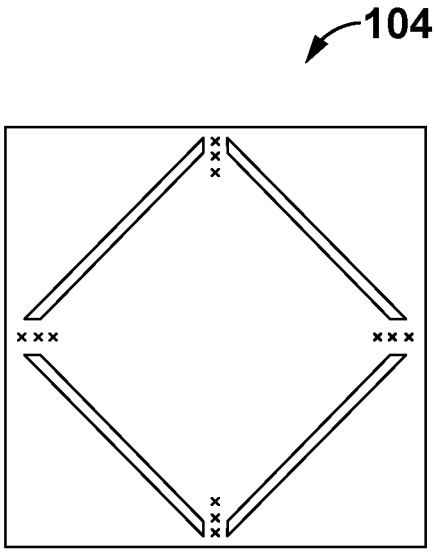
Figure 2C:
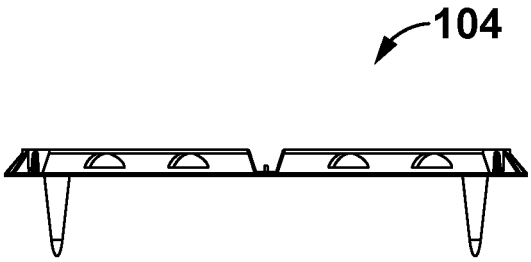
FIG. 2C and FIG. 2D illustrates a side view of the various configuration and shapes of keeper tray according to an embodiment.
Figure 2D:
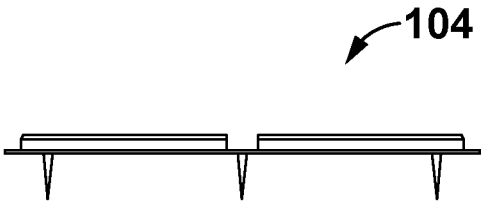
Figure 2E:
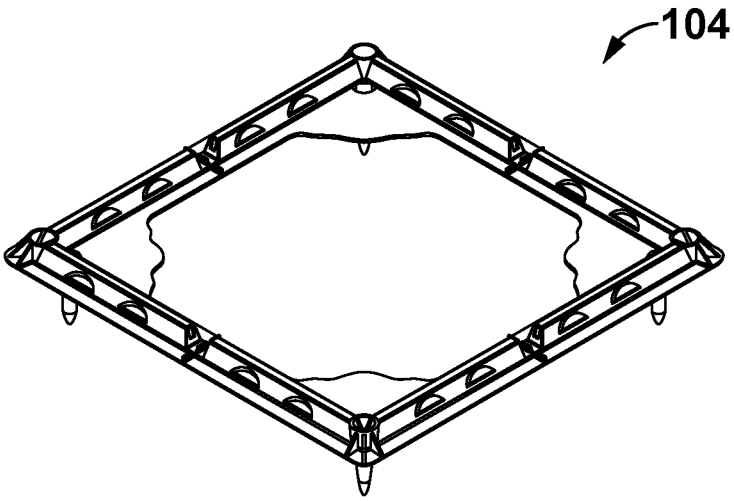
FIG. 2E and FIG. 2F illustrates a perspective view of the various configuration and shapes of keeper tray according to an embodiment.
Figure 2F:
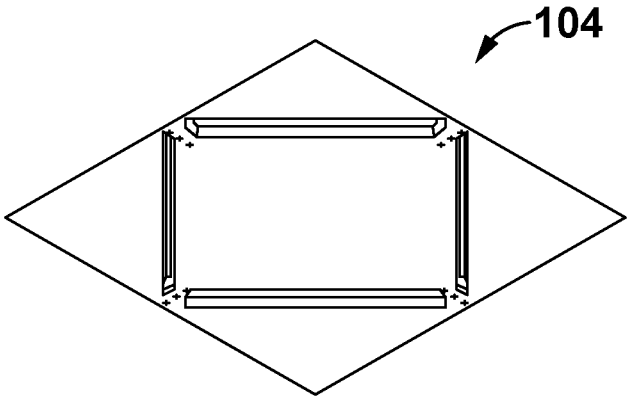
Figure 2G:
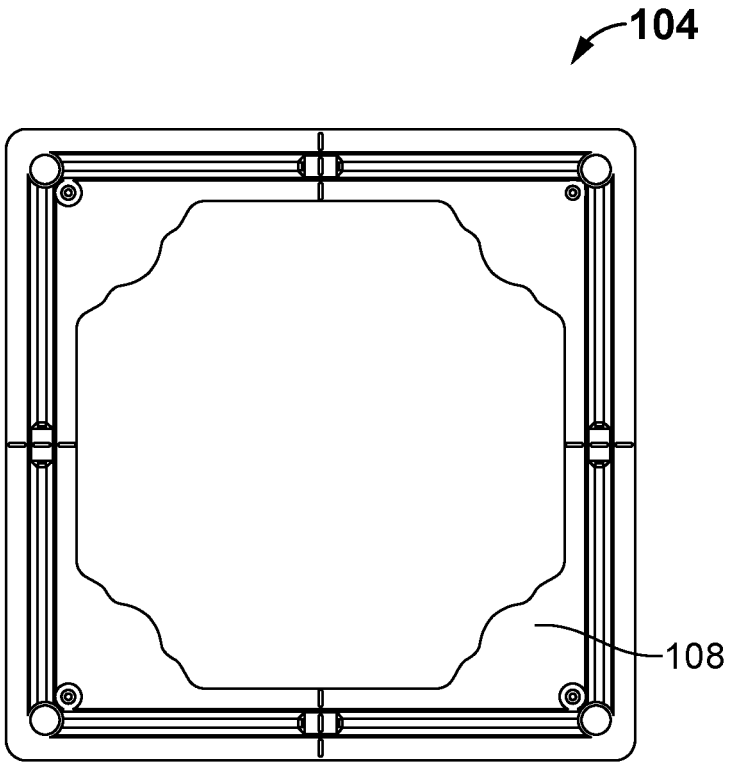
FIG. 2G and FIG. 2H, illustrate a top view and perspective view of the keeper tray with supporting surface according to an embodiment.
Figure 2H:
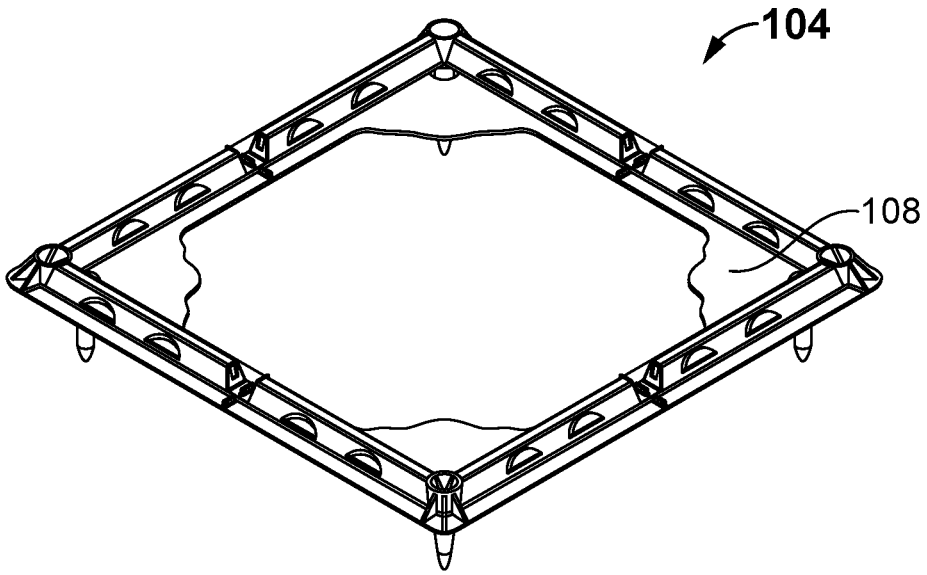

Referring to FIG. 2A-FIG. 2F, top view, side view and perspective view of the various configuration and shapes of keeper tray (102 or 104) are illustrated. Said keeper tray comprises several features and components to support the volumetric filling element 106 of the filler 100. Referring to FIG. 2G and FIG. 2H, top view and perspective view of the keeper tray (102 or 104) with a punch resistant plate 108 are illustrated. In one embodiment, the upper keeper tray 102 is attached to a top of the volumetric filling element 106 and the lower keeper tray 104 is attached to a bottom of the volumetric filling element 106. In another embodiment, the volumetric filling element 106 is a high-density material, where the filler 100 for use in a two-way concrete slab is incorporated without upper keeper tray 102 and lower keeper tray 104. In some embodiments, the volumetric filling element 106 is made of a light-weight material. In one embodiment, the volumetric filling element 106 is carved to enable adjustable geometrical structure and size of the filler 100.

In one embodiment, the light-weight material is selected from a group comprising any one of polystyrene, polyurethane, polyethylene, concrete foam clay, gas concrete, autoclaved aerated concrete (AAC), or any combination thereof. In some embodiments, the light-weight material is a sound insulator, heat insulator, or both. In one embodiment, the volumetric filling element 106 is a cubic-shaped element with one or more chamfer edges. In one embodiment, the cubic-shaped element with one or more chamfer edges is configured to prevent concrete honeycombing at the bottom surface of the slabs. In an embodiment, the cubic-shaped element with one or more chamfer edges further enables haunch connection in a junction between a web and a flange. In one embodiment, the haunch connection is configured to increase section modulus of one or more joists formed between the volumetric filling elements 106. In one embodiment, the joist comprises one or more stirrups and steel wires. The stirrups and steel wires fastens the upper keeper tray 102 and the lower keeper tray 104 to encompass the volumetric filling element 106 to resist buoyancy force of the feeding concrete. In another embodiment, the haunch connection is further configured to reduce stress concentration in the junction between web and flange.

In shear force calculation, most shear force is applied in 45 degrees in the slabs sections and the resisting shear stirrups should be perpendicular with shear force to resist against these forces. Generally, the steel sawhorse legs are creating in "W" shape, so always only one leg will perpendicular with shear force to resist against it, and the next leg capacity is not included in the shear force reinstating potential. Vertical stirrups replacement with "W" shape sawhorse resist against shear force in this kind of slabs is the better economical choice.

As calculation show, concrete flow buoyancy force during voided slabs concrete pouring is 190 $Kg/m^2$, for example, assuming each void volume is equal to 0.052 $m^3$. While the most weight of upper keeper tray and lower keeper tray, workers and equipment rarely exceed from 120 $Kg/m^2$. A method to control buoyancy force is utilization of concrete weight that earn up to 540 $Kg/m^2$, by fastening top mesh to bottom mesh. Rebars on upper keeper tray and rebars under lower keeper tray is closed to each other by stirrups, and to fasten lower keeper tray by steel wire in appropriate distances. Henceforth, the concrete weight force confronts with the concrete flow uplift force.

Referring to FIG. 5A-FIG. 5D, different views of the keeper tray (102 or 104) incorporated with a plurality of rebar 204 and surrounding spacers 206 are illustrated. In one embodiment of the present invention, the filler 100 for use in a two-way concrete slab further comprises one or more spacers 206 positioned on the keeper tray (102 or 104).

In one embodiment of the present invention, the upper keeper tray 102 and the lower keeper tray 104 are fasten or welded via one or more stirrups to the rebar 204. The rebar 204 is configured to form coop or hutch around the volumetric filling element 106. The rebar 204 is further configured to maintain predetermined distance between the volumetric filling elements 106 to resist shear force and moments in the slab. In one embodiment, the upper keeper tray 102 and lower keeper tray 104 is made of plastic, wood or steel. In some embodiments, the volumetric filling element 106 is one of geometric shape including cube, cylinder, sphere, truncated pyramid and combination thereof.

Figure 3A:
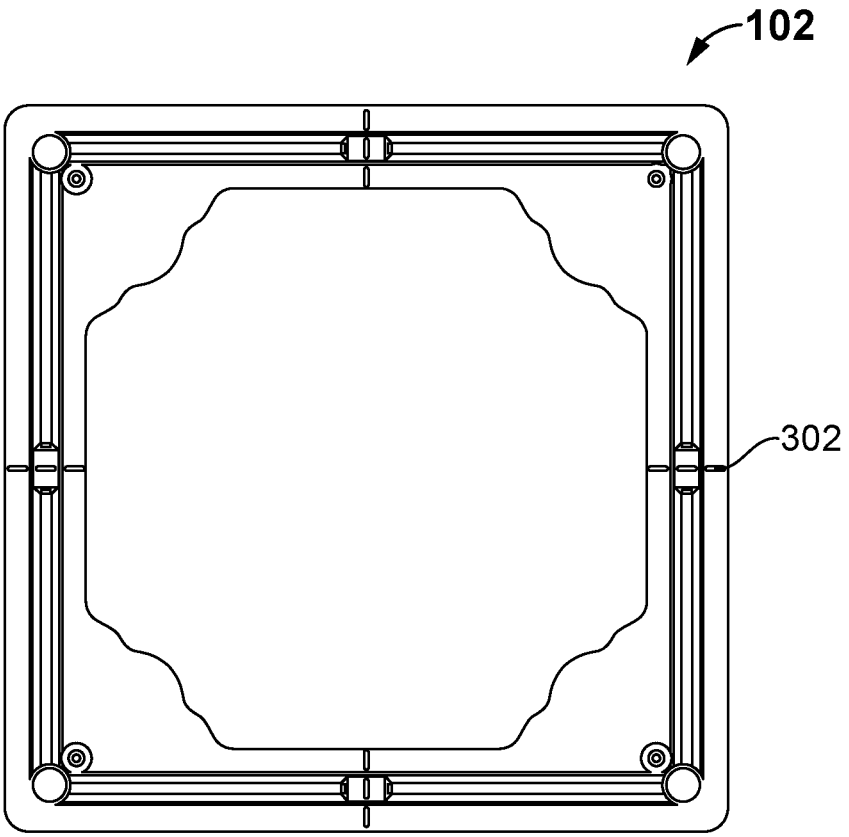
FIG. 3A illustrates a top view of the keeper tray implemented with ridges or linear ridges such as triple linear ridges according to an embodiment.
Figure 3B:
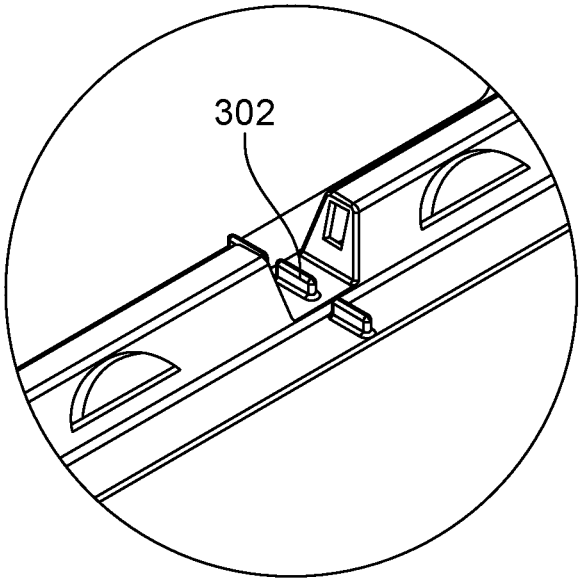
FIG. 3B illustrates a sectional view of the keeper tray implemented with ridges or linear ridges such as triple linear ridges according to an embodiment.

In one embodiment, the keeper tray (102 or 104) is configured to distribute load on the volumetric filling element 106 by the punch resistant plate 108. In some embodiments, the keeper tray (102 or 104) comprises one or more ridges 302. Referring to FIG. 3A and FIG. 3B, top and sectional view of the keeper tray (102 or 104) implemented with ridges or linear ridges 302 such as triple linear ridges is illustrated.

In another embodiment, the keeper tray (102 or 104) is further configured to securely hold the volumetric filling element 106. In one embodiment of the present invention, the filler 100 for use in a two-way concrete slab further comprises one or more spacers 206 positioned on the keeper tray (102 or 104). In one embodiment, the spacers 206 is positioned around the keeper tray (102 or 104) to maintain sufficient distance/space between the rebar 204 and filler 100. Further, the spacer 206 is configured to provide sufficient resistance under point load and tensile forces. For example, the point load that created by walking of a workman, and tensile force under the influence of bending of loads in the volumetric filling elements 106.

Figure 9:
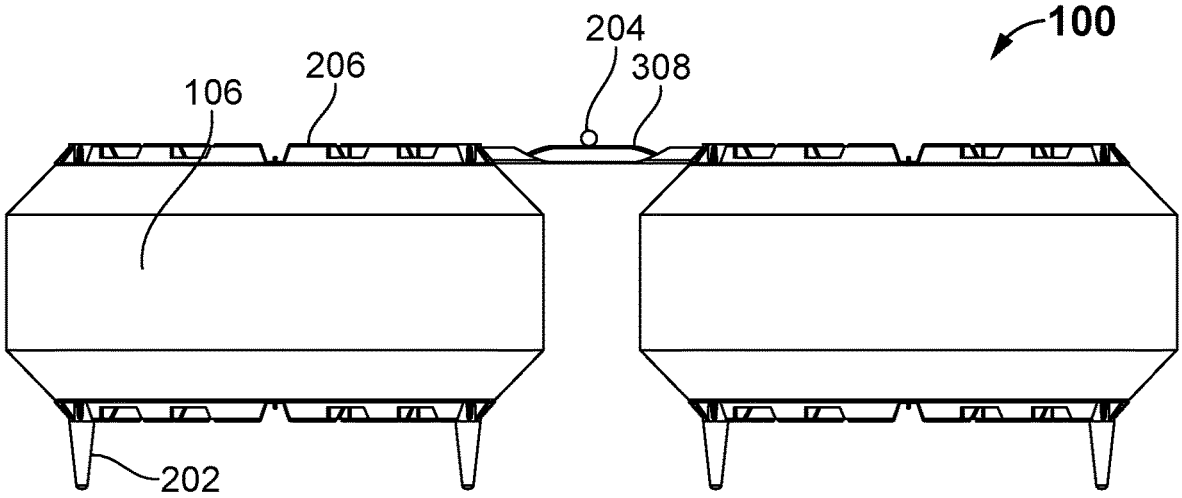
FIG. 9 illustrates a side view of the connected fillers incorporated with the belt and the rebar according to an embodiment.

Referring to FIG. 9, side view of the connected fillers 100 incorporated with the belt 308 and the rebar 204 is illustrated. In one embodiment, the filler 100 further comprises one or more grooves 304 (shown in FIG. 6A-FIG. 6D) at an end of the spacer 206, configured to securely hold one or more belts 308. In one embodiment, the filler 100 further comprises at least one belt 308 configured to attach at least one upper keeper tray 102, lower keeper tray 104, or both. In one embodiment, the belt 308 is configured to connect the filler 100 to an adjacent filler of the concrete slab, and support at least partial load exerted by the rebar 204 of the concrete slab.

The belt 308 is configured perform two important tasks. First, to fix the fillers 100 in all directions with a calculated or predetermined space from each other and prevent the movement of the volumetric filling elements 106. After pouring/feeding concrete, the space between the volumetric filling elements 106 forms a concrete joist in the slab. In the other word, the joist width is the space, which is created by belts 308. Second, the belts 308 is configured to hold top rebar 204 located between the two volumetric filling elements 106. Top rebar 204 in the filler 100 is the concrete joists top reinforcement.

Figure 10A:
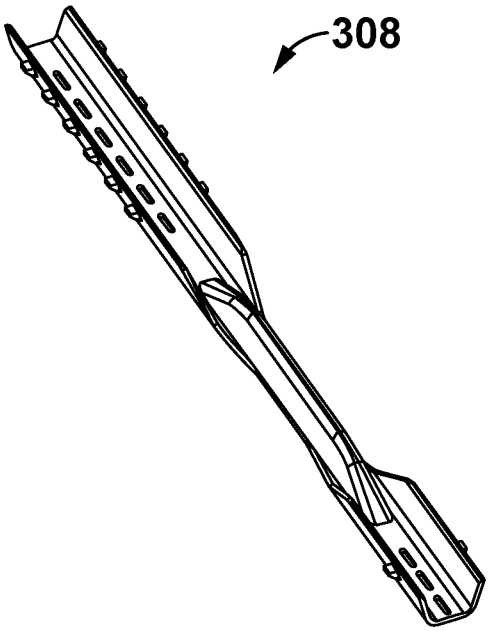
FIG. 10A illustrates a perspective view of the belt according to an embodiment.
Figure 10B:
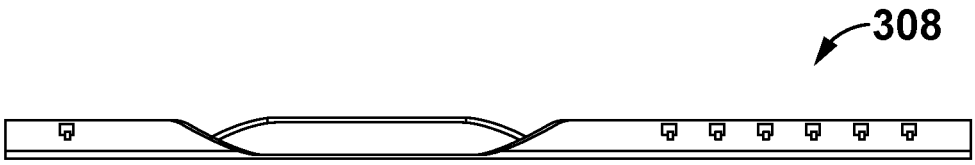
FIG. 10B illustrates a side view of the belt according to an embodiment.
Figure 10C:
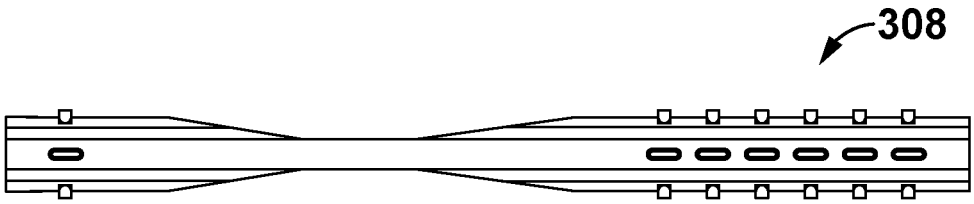
FIG. 10C illustrates a top view of the belt according to an embodiment.
Figure 11A:
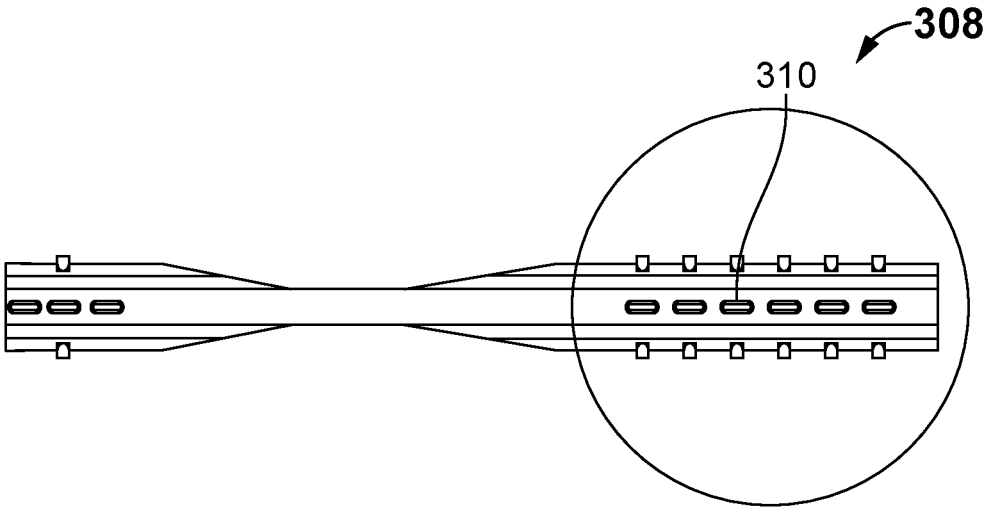
FIG. 11A and FIG. 11B, illustrate a top view and top sectional view of the multiple linear grooves on the belt according to an embodiment.
Figure 11B:
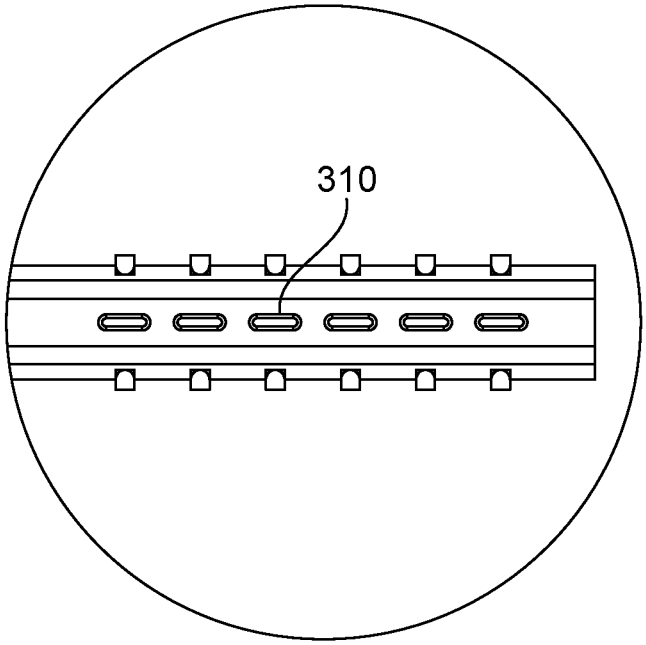
Figure 11C:
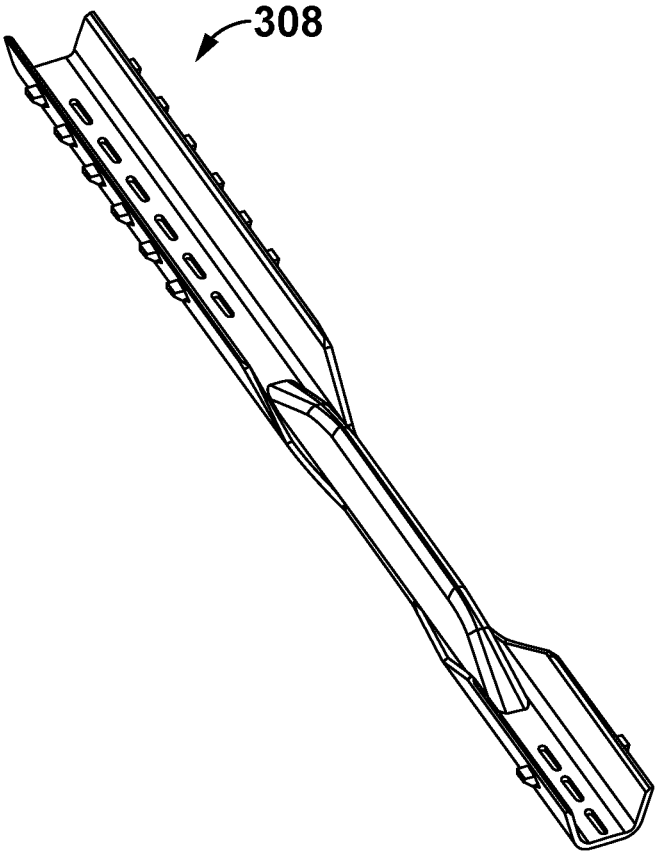
FIG. 11C and FIG. 11D, illustrate a top perspective view and sectional view of the triple linear grooves on the belt according to an embodiment.
Figure 11D:
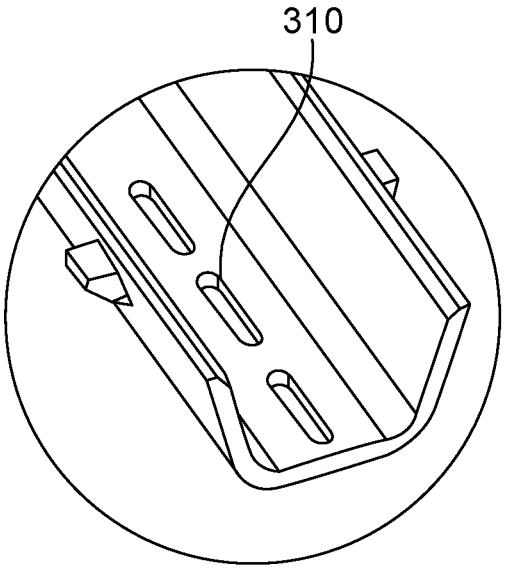
Figure 12A:
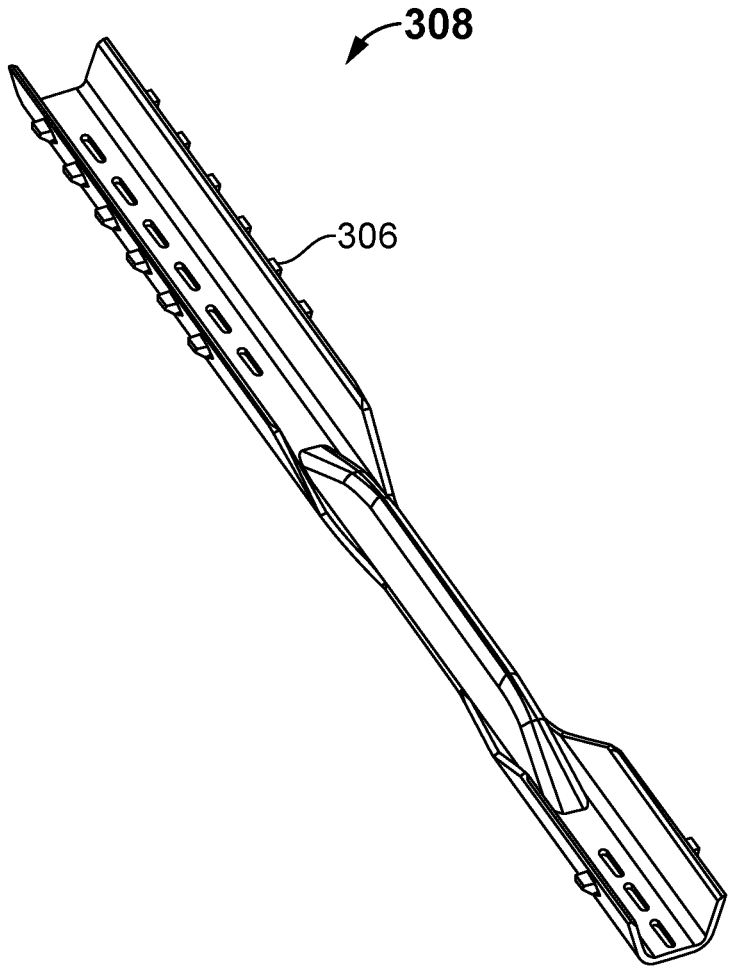
FIG. 12A and FIG. 12B, illustrate a top perspective view and sectional view of the ridges on the belt according to an embodiment.
Figure 12B:
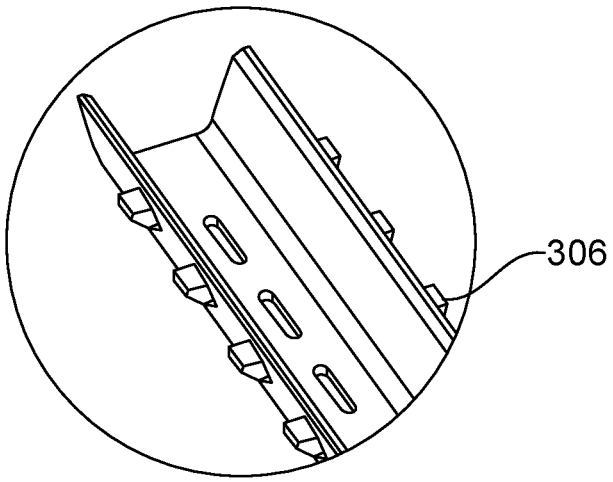
Figure 12C:
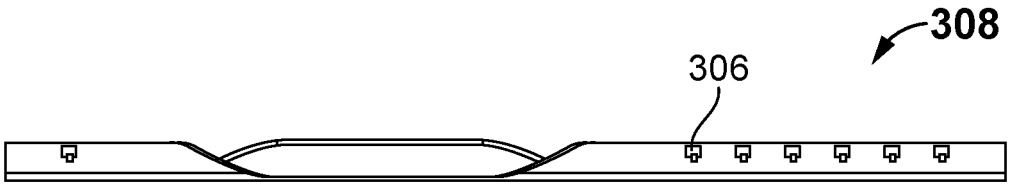
FIG. 12C illustrates a side view of the ridges on the belt according to an embodiment.
Figure 12D:
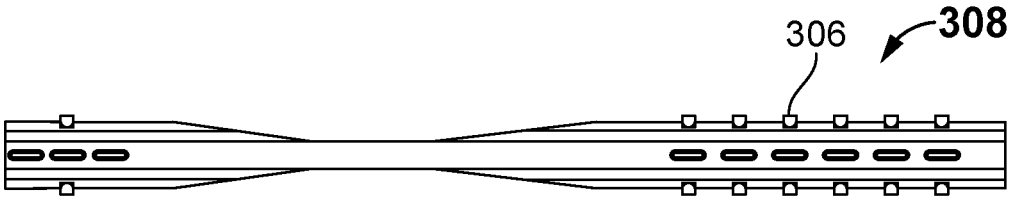
FIG. 12D illustrates a top view of the ridges on the belt according to an embodiment.
Figure 12E:
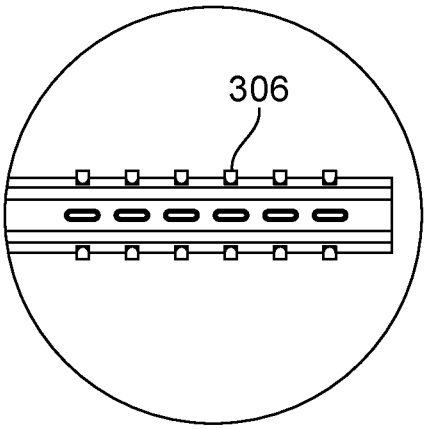
FIG. 12E illustrates a top sectional view of the ridges on the belt according to an embodiment.

Referring to FIG. 10A-FIG. 10C, different views of the belt 308 are illustrated. In one embodiment, the belt 308 is configured to securely hold the fillers 100, via a fastening means. In some embodiments, the incorporation of the belt 308 on the keeper tray (102 or 104) depends on shape and location of the keeper tray (102 or 104) and belt 308, and number of ridges and grooves in the keeper tray (102 or 104) and belt 308. In one embodiment, the belt 308 is configured to limit one or more movement of at least two volumetric filling elements 106.

Referring to FIG. 6A-FIG. 6D, different view of the keeper tray (102 or 104) incorporated with grooves 304 on the belt 308 are illustrated. The grooves 304 on the keeper tray (102 or 104) is configured to lock the belt 308 firmly via one or more ridges 302. The belt 308 and the groove 304 locking assembly will prevent the belt 308 jumping out of the keeper tray (102 or 104). In one embodiment, the linear ridges 302 on the keeper tray (102 or 104) and grooves 304 on the belt 308 to limit one or movement of at least two volumetric filling elements 106. In some embodiments, the movement is horizontal, vertical or rotational movement. In one embodiment, the belt 308 is further configured to position the rebar 204 between the volumetric filling elements 106.

Figure 4A:
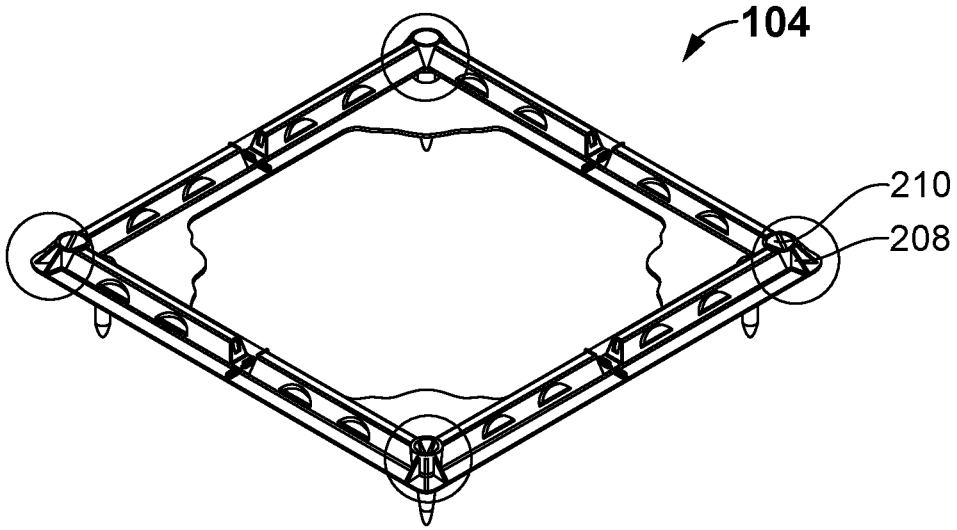
FIG. 4A illustrates a top perspective view of the keeper tray implemented with indicator seat or leg seat according to an embodiment.
Figure 4B:
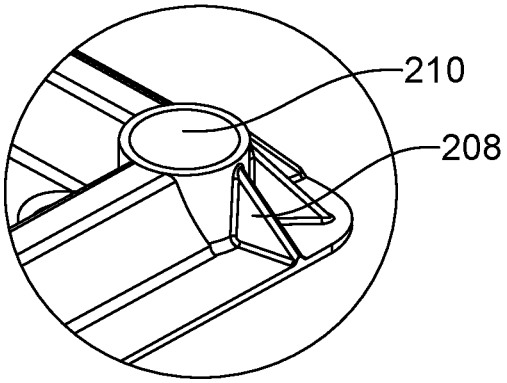
FIG. 4B illustrates a sectional view of the keeper tray implemented with indicator seat or leg seat supported by one or more buttress according to an embodiment.
Figure 4C:
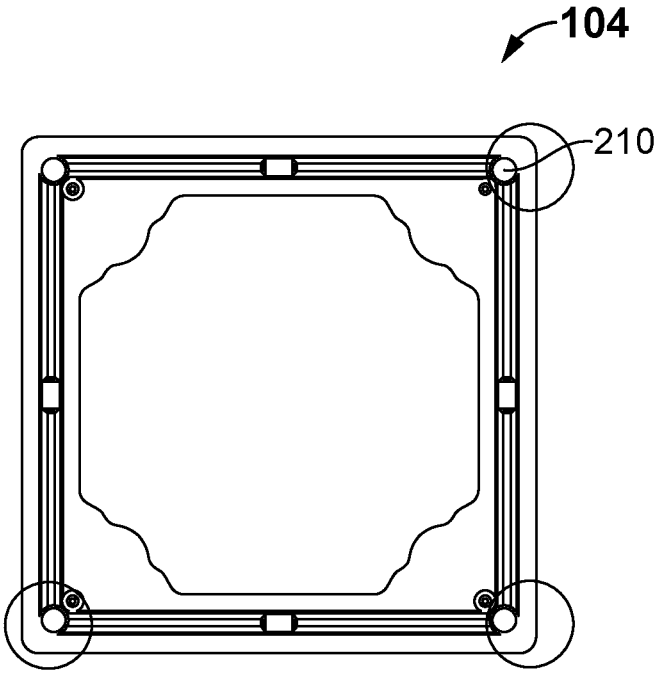
FIG. 4C illustrates a top view of the keeper tray implemented with indicator seat or leg seat according to an embodiment.
Figure 5A:
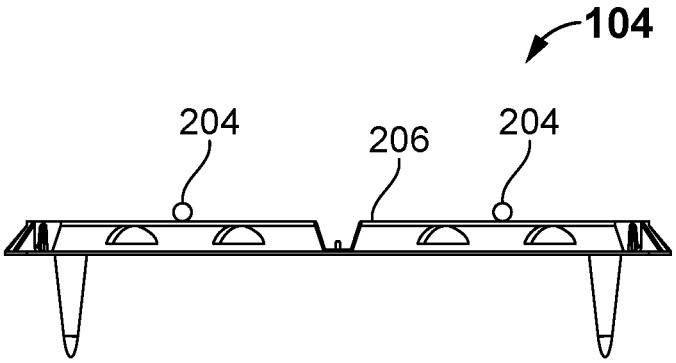
FIG. 5A illustrates a side view of the keeper tray incorporated with the rebar and surrounding spacer according to an embodiment.
Figure 5B:
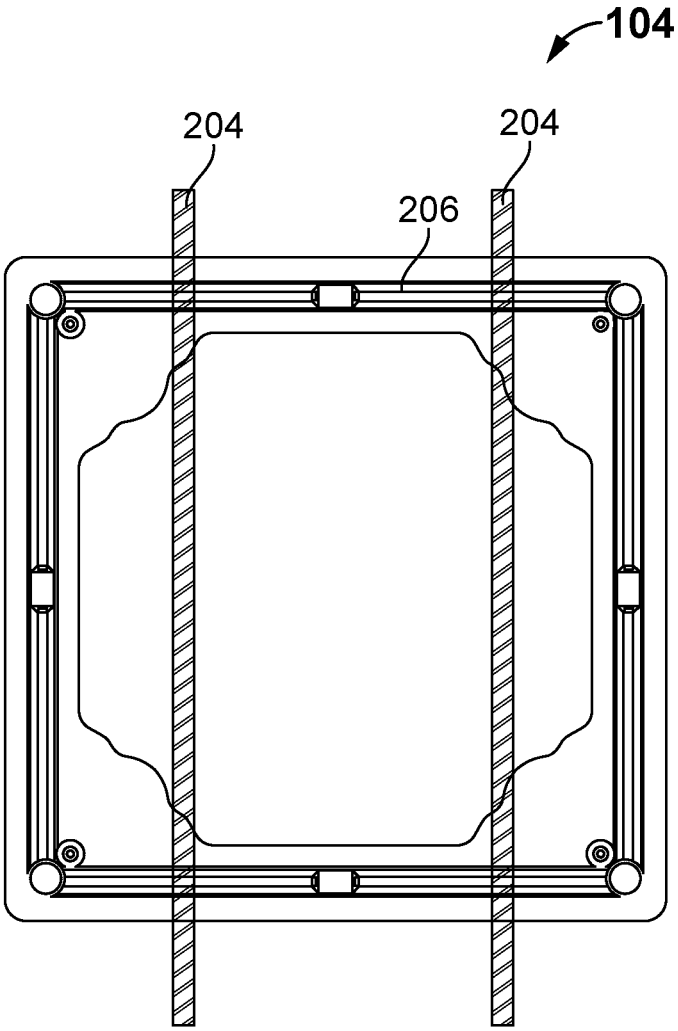
FIG. 5B illustrates a top view of the keeper tray incorporated with the rebar and surrounding spacer according to an embodiment.
Figure 5C:
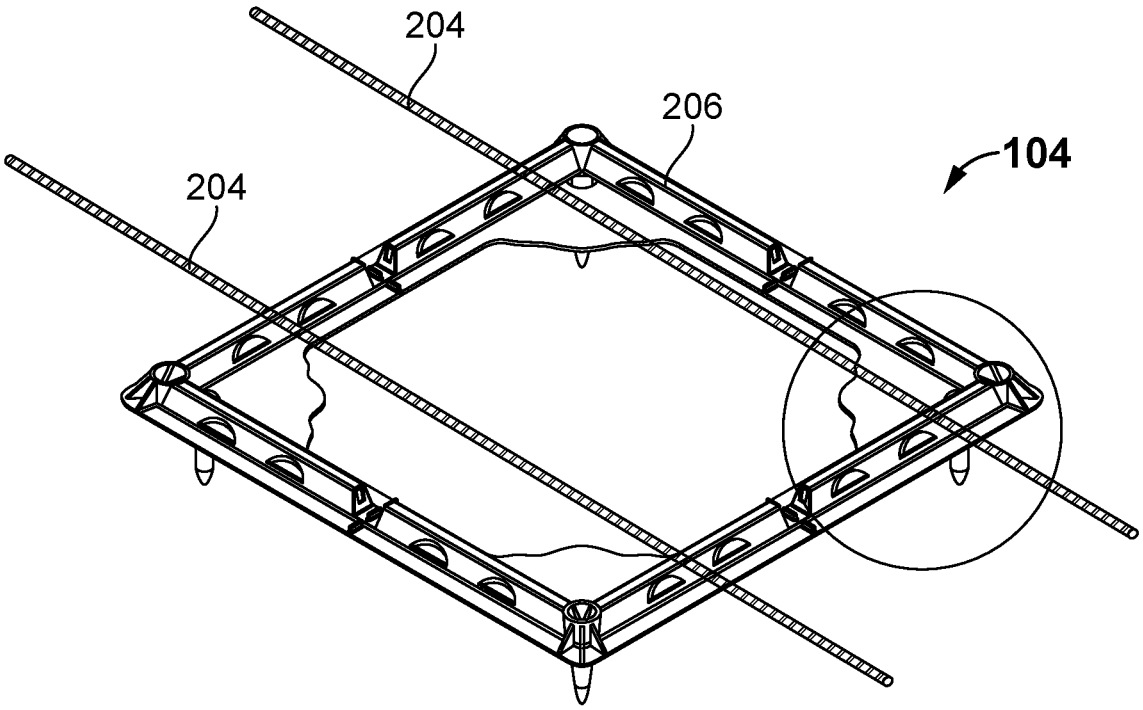
FIG. 5C illustrates a top perspective view of the keeper tray incorporated with the rebar and surrounding spacer according to an embodiment.
Figure 5D:
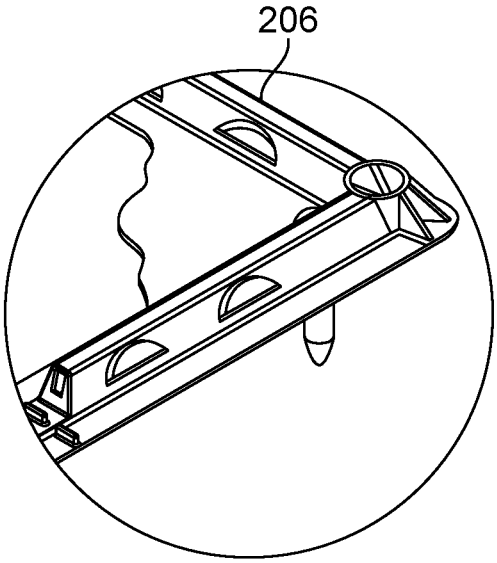
FIG. 5D illustrates a sectional view of the keeper tray incorporated with the surrounding spacer and punch resistance plate according to an embodiment.
Figure 6A:
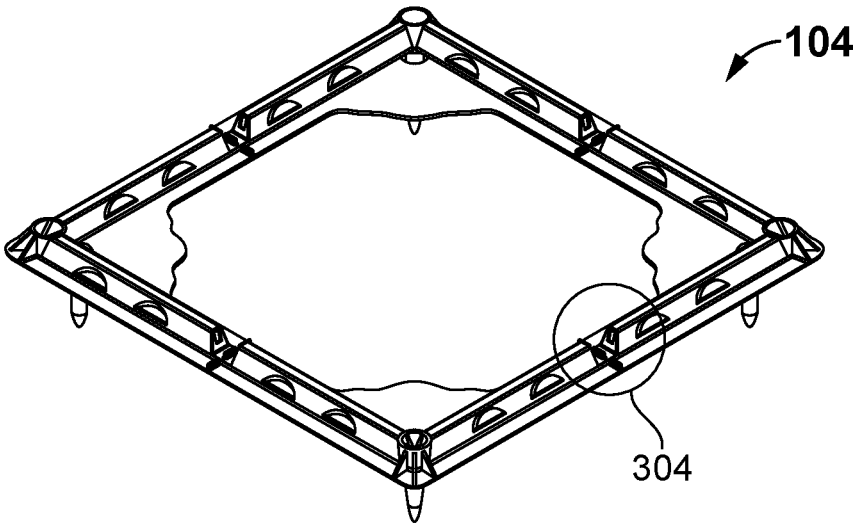
FIG. 6A and FIG. 6B, illustrate a top perspective view and sectional view of the keeper tray incorporated with grooves on the belt according to an embodiment.
Figure 6B:
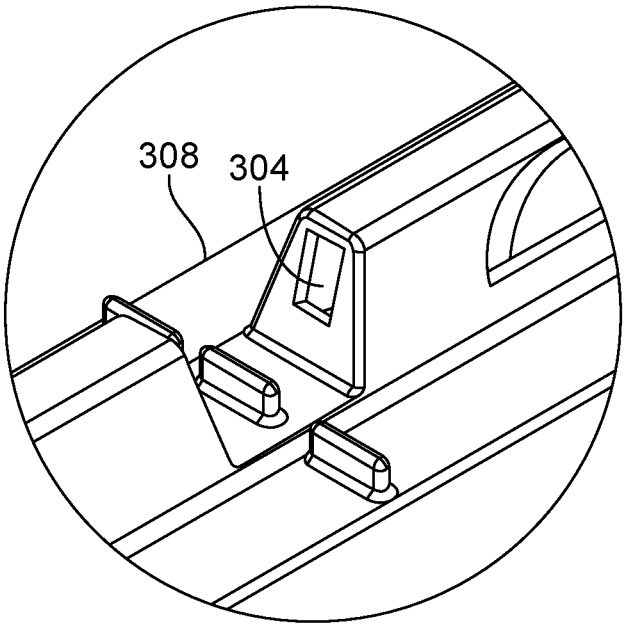
Figure 6C:
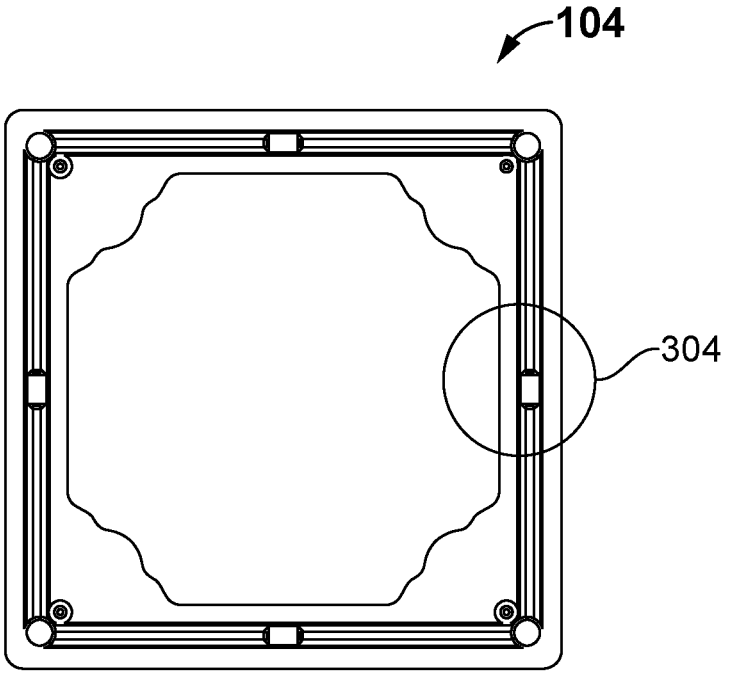
FIG. 6C and FIG. 6D, illustrate a top view and top sectional view of the keeper tray incorporated with grooves on the belt according to an embodiment.
Figure 6D:
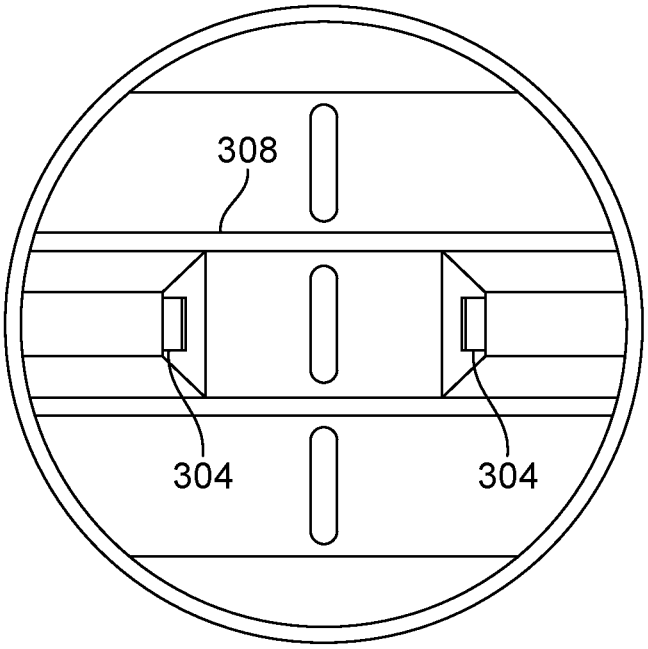
Figure 7A:
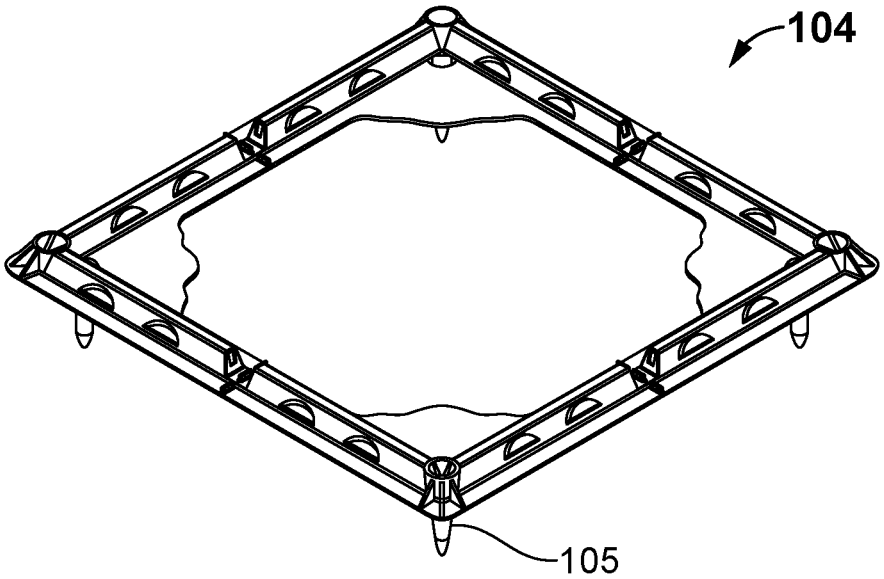
FIG. 7A and FIG. 7B, illustrate a top perspective view and sectional view of the keeper tray incorporated with nail-shaped appendices according to an embodiment.
Figure 7B:
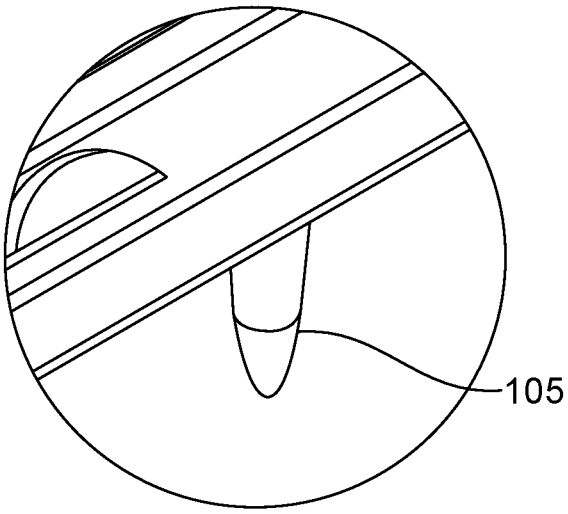
Figure 7C:
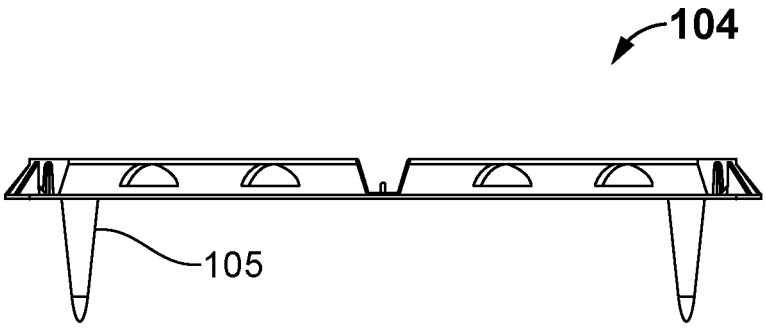
FIG. 7C and FIG. 7D, illustrate a side view and side sectional view of the keeper tray incorporated with nail-shaped appendices according to an embodiment.
Figure 7D:
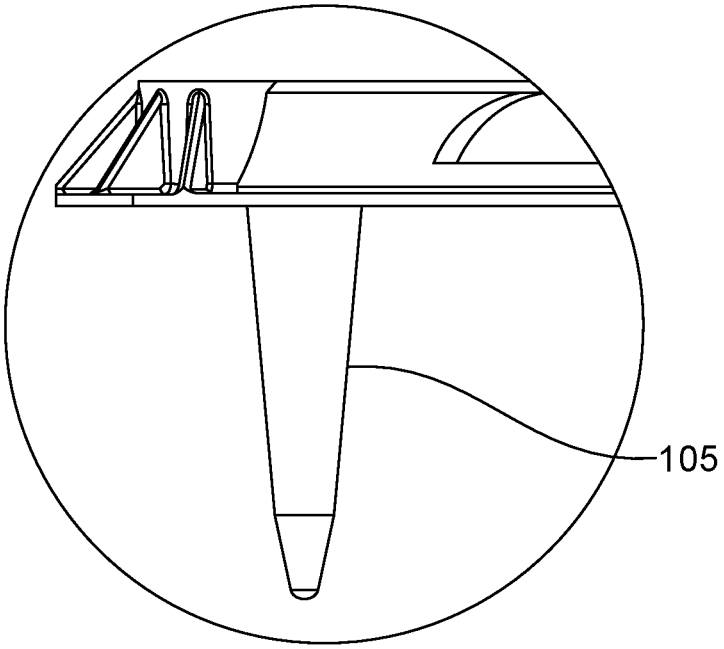
Figure 8:
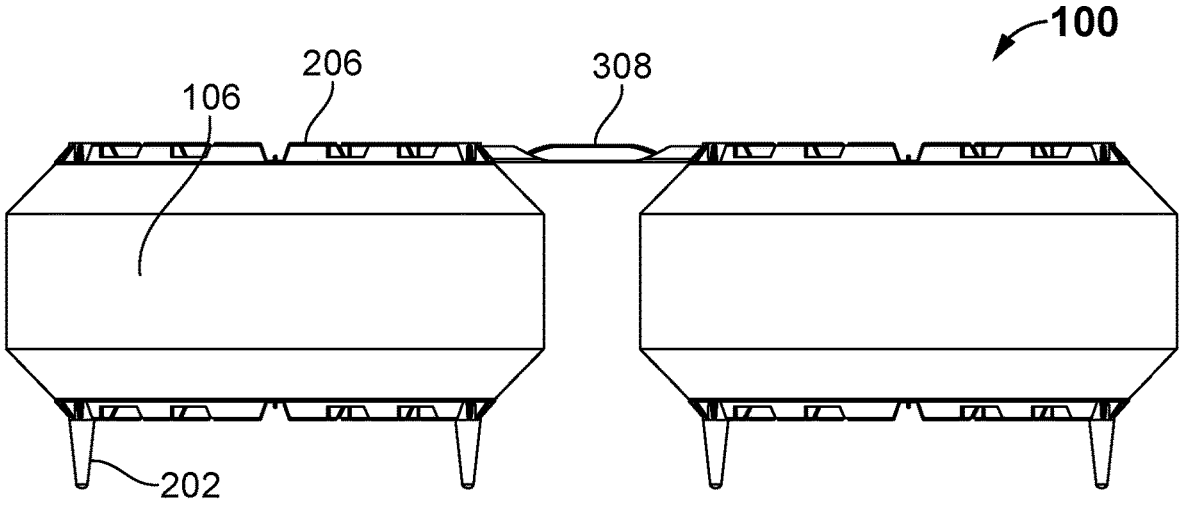
FIG. 8 illustrates a side view of the connected fillers incorporated with the legs or indicators according to an embodiment.

Referring to FIG. 4A-FIG. 4C, different views of the keeper tray (102 or 104) implemented with indicator seat or leg seat 210 is illustrated. In one embodiment, the filler 100 further comprises a plurality of indicators 202 positioned in all, or some corners of the keeper tray (102 or 104) supported via one or more buttress 208. The buttress 208 is configured to resist bending of the indicators 202. Referring to FIG. 8 and FIG. 9, different views of the connected fillers 100 incorporated with the legs or indicators 202 are illustrated. In another embodiment, the indicator 202 is configured to indicate an amount or level of a concrete fed on the filler 100. In one embodiment, the indicator 202 is configured to indicate thickness of the concrete fed on the voided volumetric filling element 106. Installable legs 202 with variable length, is configured to change the lower slab thickness in various condition.

Figure 17A:
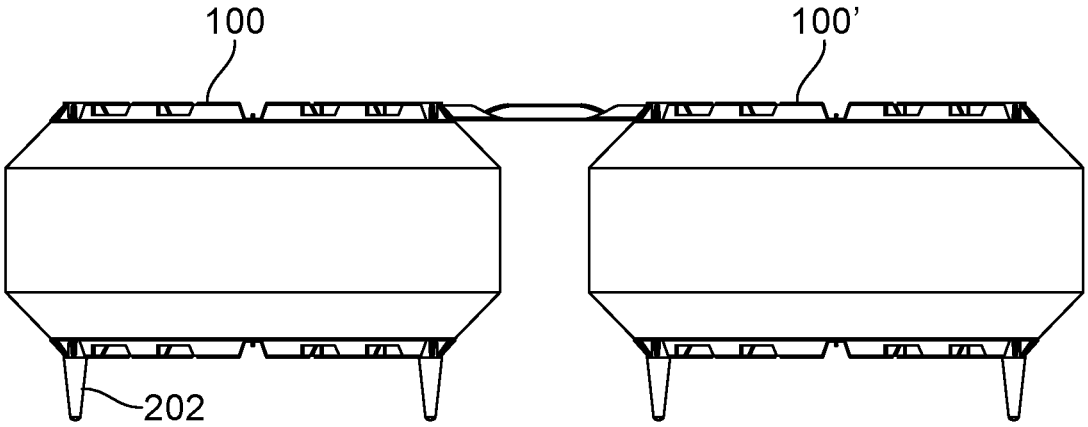
FIG. 17A illustrates a variable length of the installable legs or indicators attached on the bottom portion of the lower keeper tray according to an embodiment.
Figure 17B:
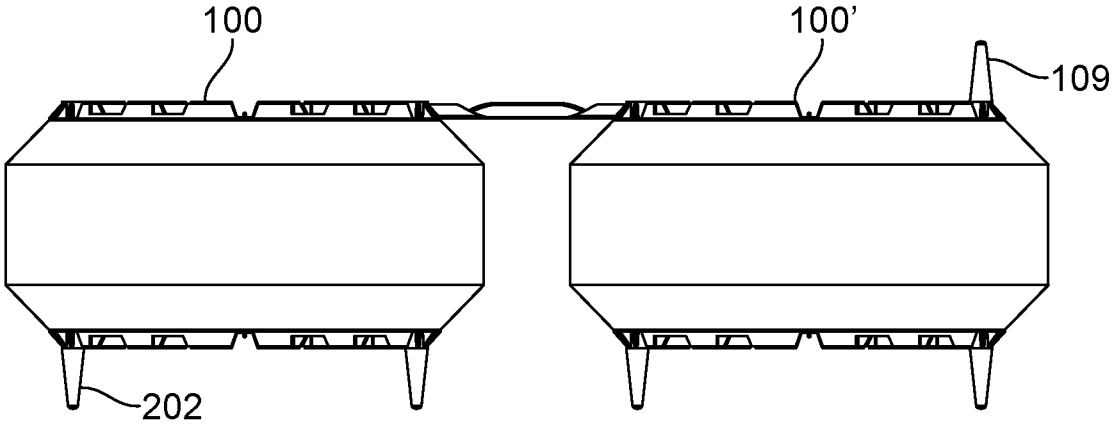
FIG. 17B shows the installable legs or indicators attached on the upper keeper tray according to an embodiment.

Referring to FIG. 17A, variable length of the installable legs attached on the bottom portion of the lower keeper tray 104 in the connected fillers (100 and 100') is illustrated. In some embodiments, the indicator 202 is a plurality of installable legs with pre-determined length mounted below the lower keeper tray 104 to allow concrete to reach under the lower keeper tray 104 while feeding the concrete. In some embodiments, the plurality of installable legs is variable in length. Referring to FIG. 17B, the installable legs or indicators 109 attached on the upper keeper tray 102 in the connected fillers (100 and 100') is illustrated. In one embodiment, the indicator 109 is positioned on the upper keeper tray 102 to indicate the status of concrete thickness fed on the voided volumetric filling element 106.

Referring to FIG. 7A-FIG. 7D, different views of the keeper tray (102 or 104) incorporated with nail-shaped appendices 105 are illustrated. In one embodiment, the at least one keeper tray (102 or 104) further comprises one or more nail-shaped appendices 105. The nail-shaped appendices 105, are configured to attach at least one keeper tray (102 or 104) to the volumetric filling element 106, via an adhesive. In one embodiment, the spacer 206 and belt 308 in the keeper tray (102 or 104) is configured to receive one or more rebar 204. Referring to FIG. 11A-FIG. 11D, various views of the multiple linear grooves 310 on the belt 308 are illustrated. In some embodiments, the belt 308 comprises one or more linear grooves 310. The linear grooves 310 in the belt 308 is configured to prevent rotation of the volumetric filling element 106 under the influence of the site load movement.

Figure 13:
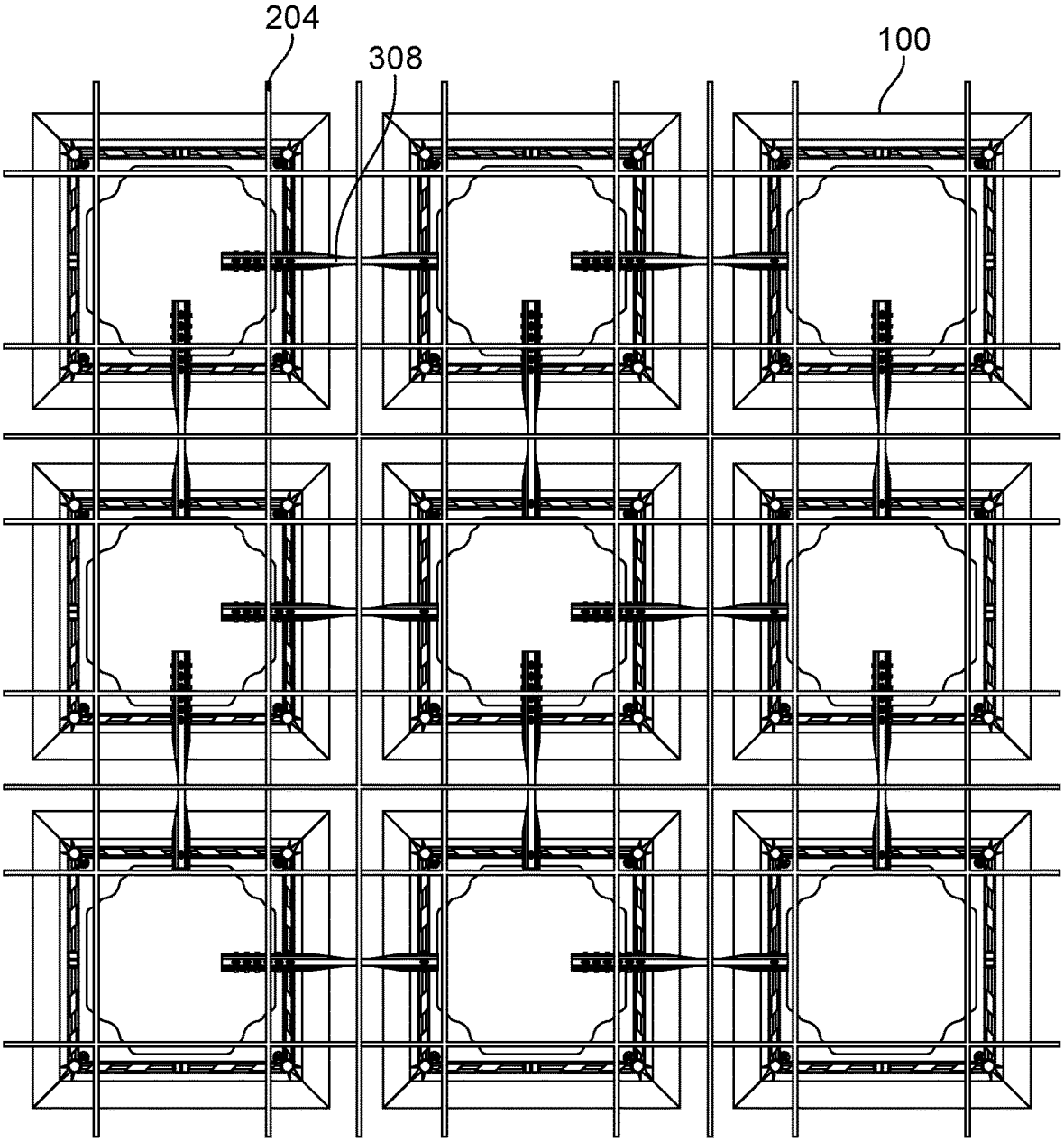
FIG. 13 illustrates a top view of an arrangement of fillers connected via the belts and the rebar according to an embodiment.

Referring to FIG. 12A-FIG. 12E, different views of the ridges 306 on the belt 308 are illustrated. In another embodiment, the belt 308 further comprises one or more additional ridges 306 on a wall of the belt 308 to lock the grooves 304 in the spacer 206. Referring to FIG. 13, an arrangement of fillers 100 connected via the belts 308 and the rebar 204 is illustrated. In one embodiment, the belt 308 is configured to connect one or more volumetric filling elements 106.

Figure 14A:
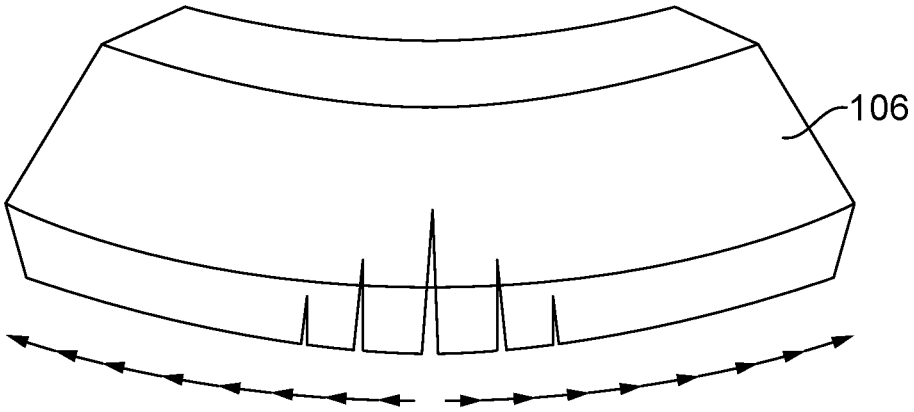
FIG. 14A illustrates a keeper tray and filler deformation equality in low sanity fillers on application of site load according to an embodiment.
Figure 14B:
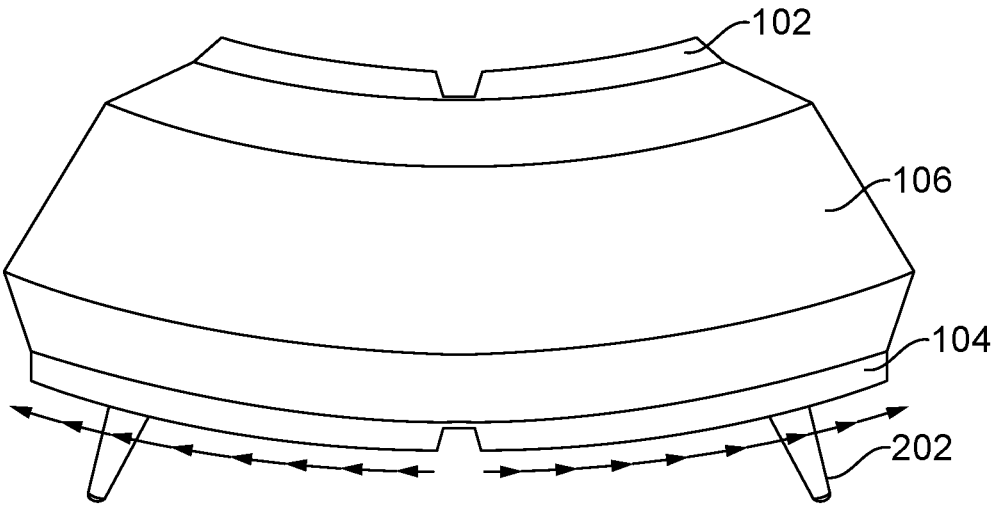
FIG. 14B illustrates a keeper tray and filler deformation equality in filler of present invention on application of site load according to an embodiment.
Figure 15A:
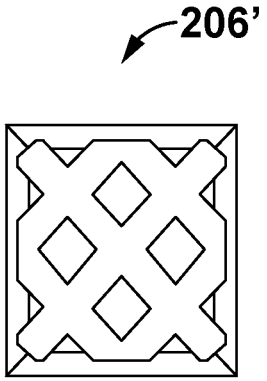
FIG. 15A-FIG. 15D illustrates a top view of the various shape and configuration of a continuous spacer embodied on the high-density fillers according to an embodiment.
Figure 15B:
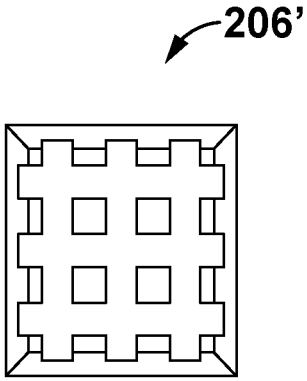
Figure 15C:
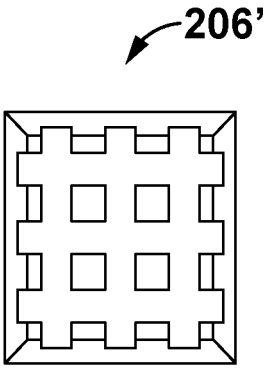
Figure 15D:
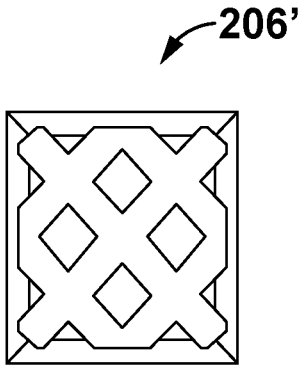
Figure 15E:
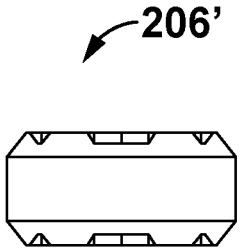
FIG. 15E-FIG. 15H illustrates a side view of the various shape and configuration of a continuous spacer embodied on the high-density fillers according to an embodiment.
Figure 15F:
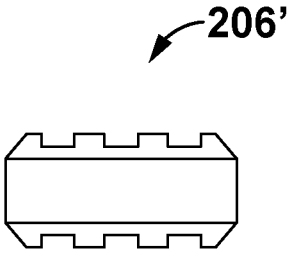
Figure 15G:
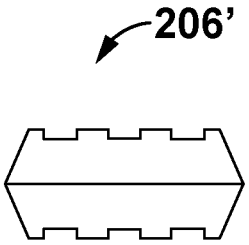
Figure 15H:
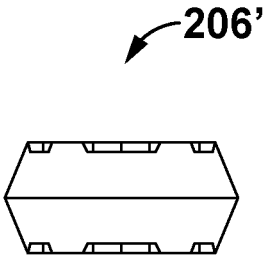
Figure 15I:
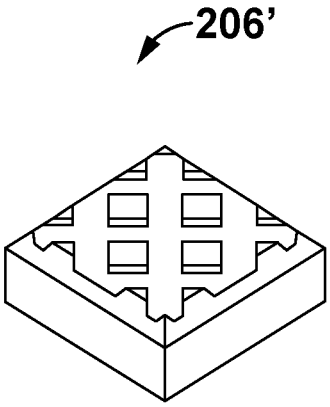
FIG. 15I-FIG. 15L illustrates a perspective view of the various shape and configuration of a continuous spacer embodied on the high-density fillers according to an embodiment.
Figure 15J:
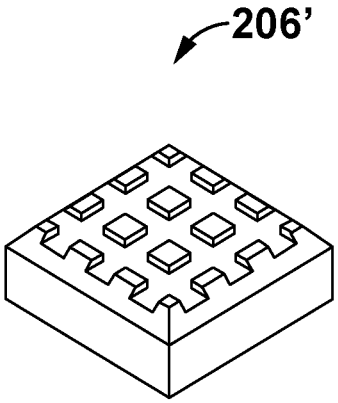
Figure 15K:
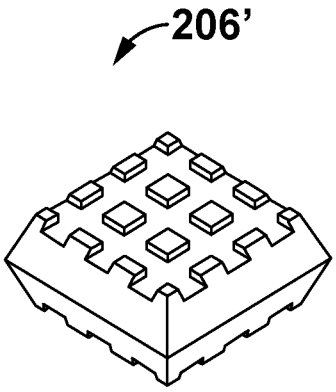
Figure 15L:
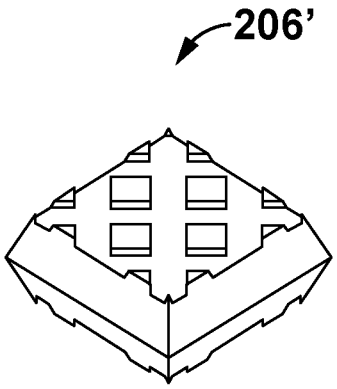

Referring to FIG. 14A, volumetric filling element 106 deformation equality in low density fillers on application of site load is illustrated. Referring to FIG. 14B, keeper tray (102 or 104) and volumetric filling element 106 deformation equality in filler of present invention on application of site load is illustrated. Use of low density fillers without matched keeper trays increase risk of fractures in fillers under the influence of site loads, for example, on moving construction workman or equipment. But the most of tension on the bottom or underside surface of boosted filler by trays is tolerate or bear by lower or underside tray (like the tensile rebars in concrete beams that the tension tolerated or withstand by rebars) and in fact the underside tray with glued nail-shape appendices is resisting against elements 106 fracture.

Referring to FIG. 15A-FIG. 15L, top view, side view and perspective view of the various shape and configuration of a continuous spacer 206' embodied on the high-density fillers 100 are illustrated. In one embodiment, the spacer 206' is a continuous fabric spacer. The volumetric filling element 106 is a high-density material with embodied spacer 206', where the filler 100 for use in a two-way concrete slab is incorporated without upper keeper tray 102 and lower keeper tray 104. Referring to FIG. 15A-FIG. 15L, the spacer 206' embodied on the high-density filler 100 performs similar to the keeper tray (102 or 104) to provide sufficient space between the rebar 204 and filler 100 and perform as a stand under the filler 100 to seat on the rebar 204.

Figure 16A:
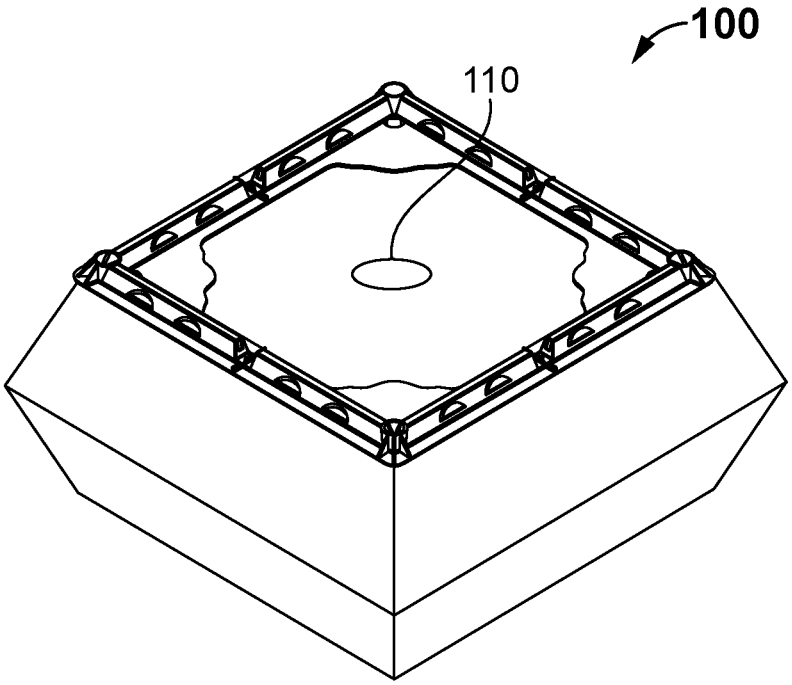
FIG. 16A illustrates a top perspective view of the filler incorporated with an exhaust hole according to an embodiment.
Figure 16B:
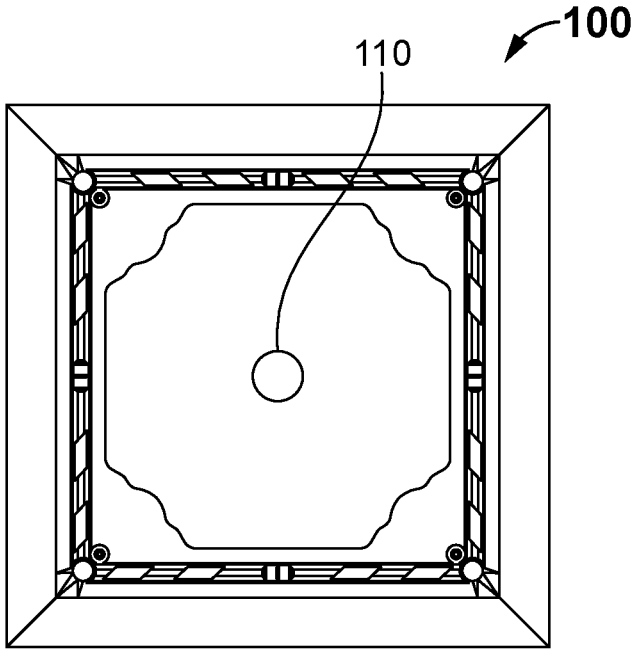
FIG. 16B illustrates a top view of the filler incorporated with an exhaust hole according to an embodiment.
Figure 16C:
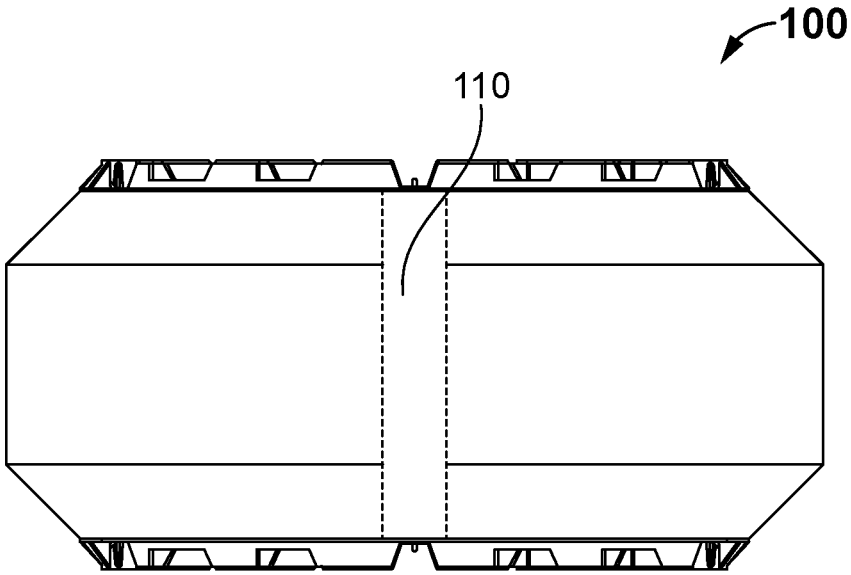
FIG. 16C illustrates a side sectional view of the filler incorporated with an exhaust hole according to an embodiment.

Referring to FIG. 16A-FIG. 16C, top perspective view, top view and side sectional view of the filler 100 incorporated with an exhaust hole 110 are illustrated. In an embodiment, the volumetric filling element 106 further includes one or more exhaust holes 110 to allow exit of the trapped air. Usually, the exhaust holes 110 embedded in the center of filler 100. In some embodiments, the exhaust holes 110 could be of various sizes, but it is necessary to have enough diameter for vibrator ingression. One of the most important benefits of the volumetric filling element 106 is the ability of size optimizing proportional to loads and span. In other words, the optimized size of elements depends on amount and effective span of an applied load. In some embodiments, the volumetric filling element 106 is variable size from 65×65 cm to 45×45 cm. The exhaust holes 110 passing through the element 106 from a bottom to a top of the volumetric filling element 106 is utilized in large size elements such as 60×60 cm, to exit the bottom surface trapped air and bring the vibrator to the center of the lower concrete slab. Further, the exhaust hole 110 in large volumetric filling element 106 prevents honeycombing in the lower concrete slab.

Figure 20A:
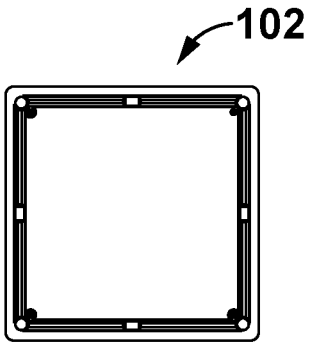
FIG. 20A-FIG. 20Q illustrate first type, where the spacer is a part of the keeper tray, according to an embodiment.
Figure 20B:
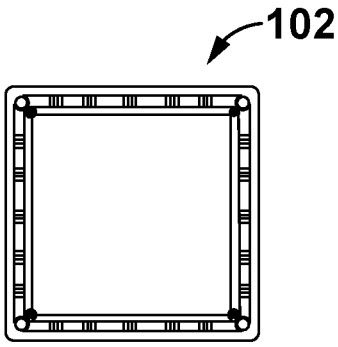
FIG. 20R-FIG. 20X, illustrate second type, where the keeper tray is installed with external spacers, according to an embodiment.
Figure 20C:
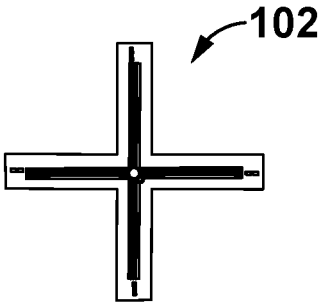
Figure 20D:
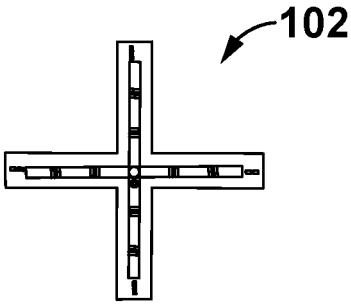
Figure 20E:
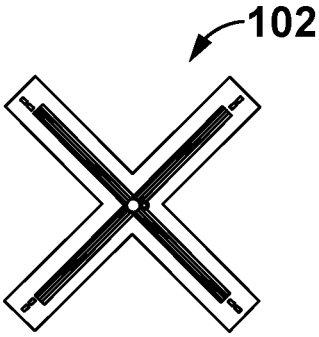
Figure 20F:
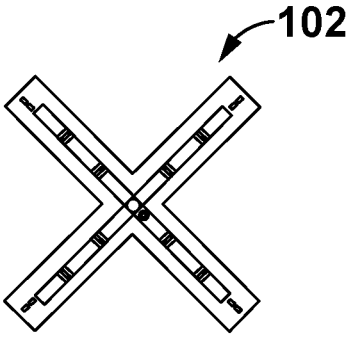
Figure 20G:
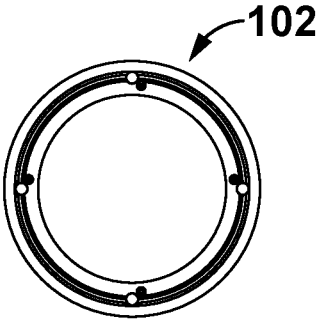
Figure 20H:
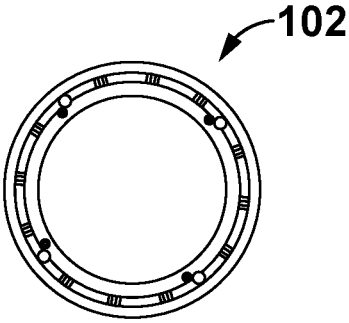
Figure 20I:
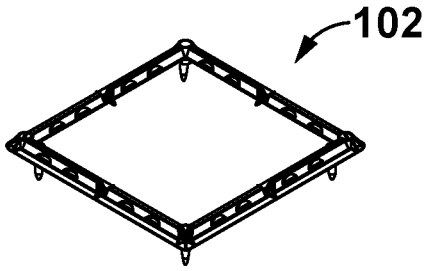
Figure 20J:
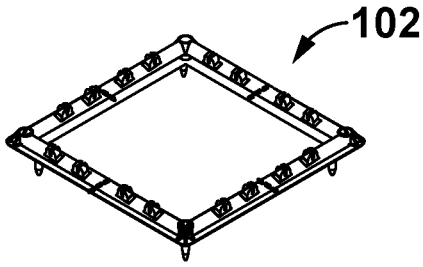
Figure 20K:
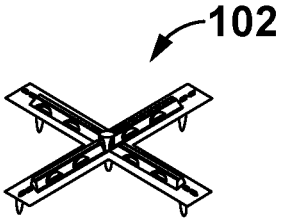
Figure 20L:
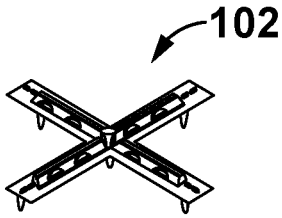
Figure 20M:
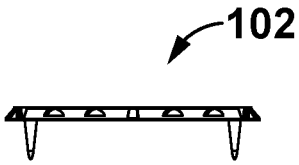
Figure 20N:
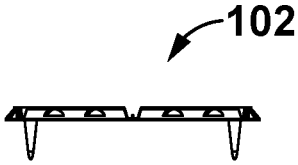
Figure 20O:
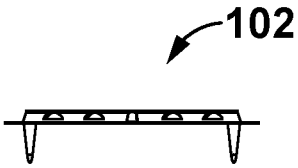
Figure 20P:
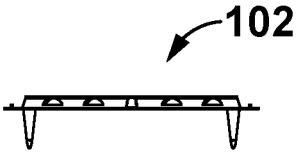
Figure 20Q:
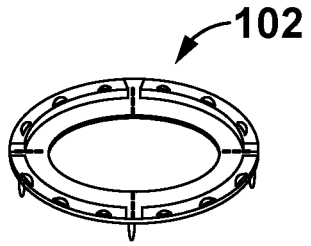
Figure 20R:
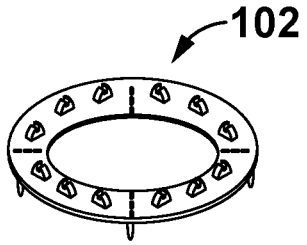
Figure 20S:
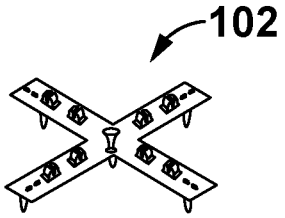
Figure 20T:
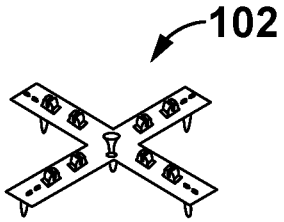
Figure 20U:
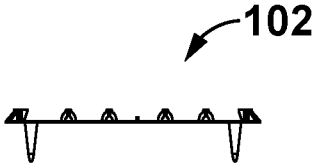
Figure 20V:
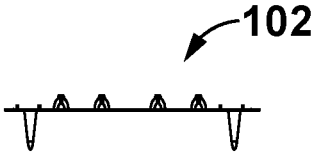
Figure 20W:
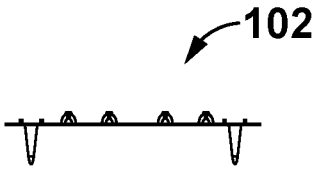
Figure 20X:
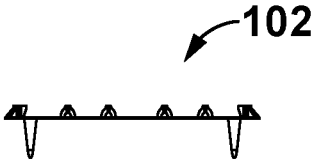
Figure 21A:
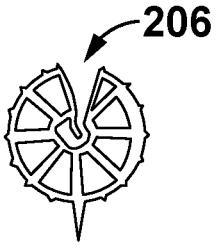
FIG. 21A-FIG. 21N illustrates a side perspective view of various shape and configuration of the external spacer according to an embodiment.
Figure 21B:
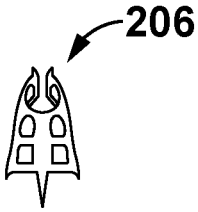
FIG. 21O and FIG. 21P illustrates a side perspective view of various shape and configuration of the external spacer with holes installable on the keeper tray according to an embodiment.
Figure 21C:
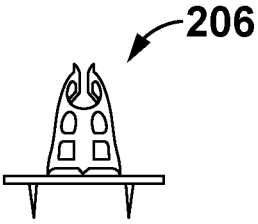
Figure 21D:
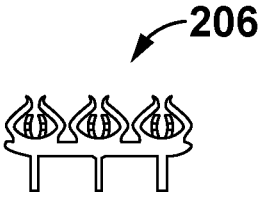
Figure 21E:
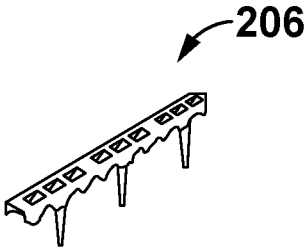
Figure 21F:
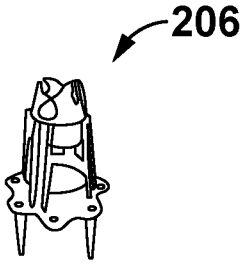
Figure 21G:
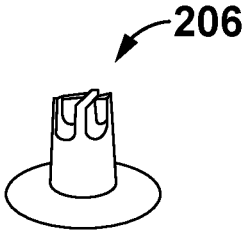
Figure 21H:
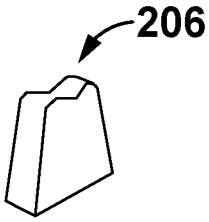
Figure 21I:
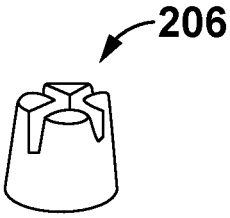
Figure 21J:
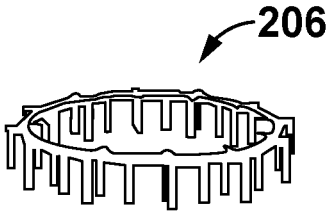
Figure 21K:
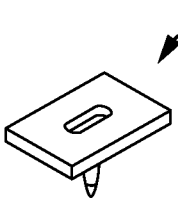
Figure 21L:
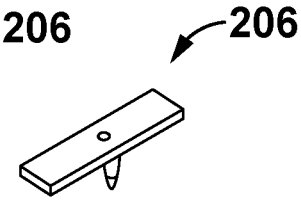
Figure 21M:
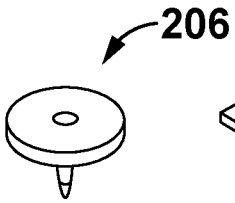
Figure 21N:
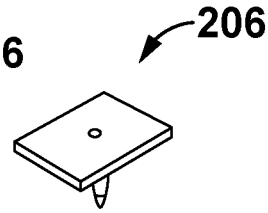
Figure 21O:
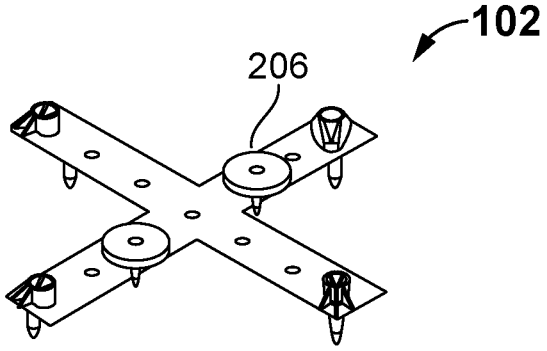
Figure 21P:
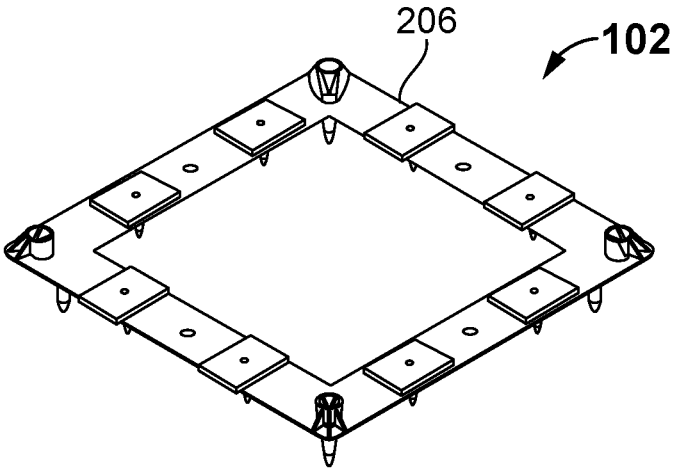

Referring to FIG. 20A-FIG. 20X, top view, top perspective view and side view of various shape and configuration of the spacers 206 installable on the keeper tray (102 or 104) are illustrated. In one embodiment, the present invention comprises any one of the two types of keeper tray (102 or 104). In first type of keeper tray (102 or 104), the spacer 206 is a part of the keeper tray. This configuration is single-piece configuration, with the spacer 206 on top. The second type of keeper tray (102 or 104) uses external spacers 206 that are positioned on the keeper trays (102 or 104). In second type, the keeper tray (102 or 104) does not require additional spacer, or other external spacers 206. Further, the spacer 206 is detachably fixed to the keeper tray (102 or 104) in different configuration. Referring to FIG. 20A-FIG. 20Q, a first type is illustrated, where the spacer is a part of the keeper tray (102 or 104) which does not require external spacers. Referring to FIG. 20R-FIG. 20X, a second type is illustrated, where the keeper tray (102 or 104) are installed with external spacer 206 (shown in FIG. 21A-FIG. 21N). FIG. 21A-FIG. 21N illustrates a side perspective view of various shape and configuration of the external spacer 206 according to an embodiment. FIG. 21O and FIG. 21P illustrates a side perspective view of various shape and configuration of the external spacer 206 installable on the keeper tray (102 or 104) according to an embodiment. Further, the external spacers 206 comprises one or more holes, as shown in FIG. 21O and FIG. 21P.

Figure 18A:
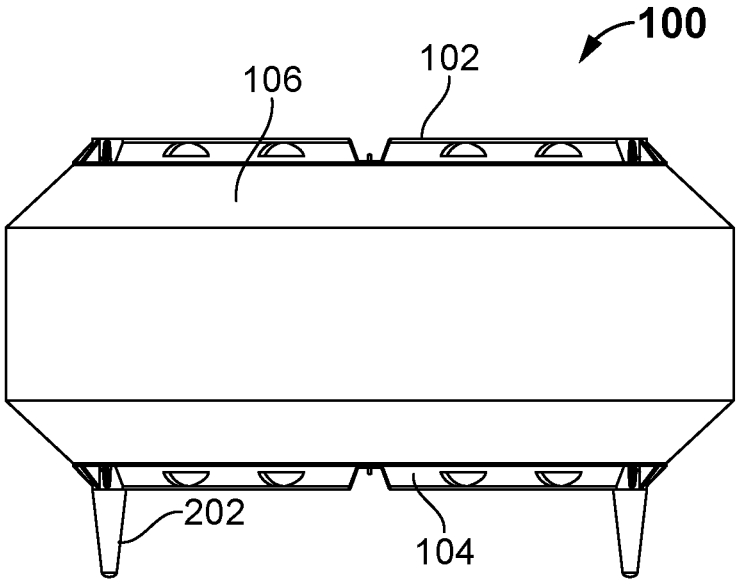
FIG. 18A illustrates a side view of the filler incorporated with the keeper tray, volumetric filling element, and installable legs or indicators attached on the bottom portion of the lower keeper tray according to an embodiment.
Figure 18B:
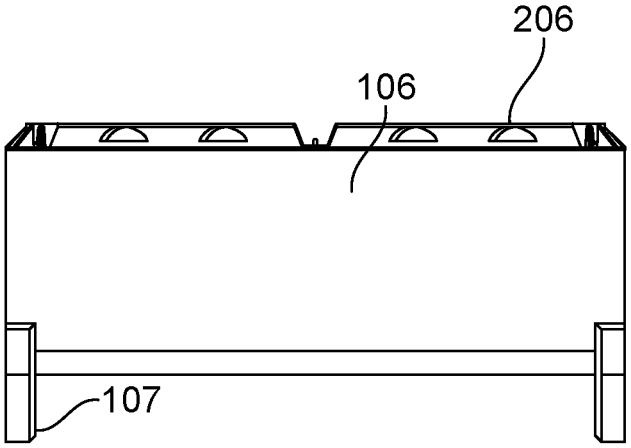
FIG. 18B illustrates a side view of the filler incorporated with external holder and spacer.
Figure 18C:
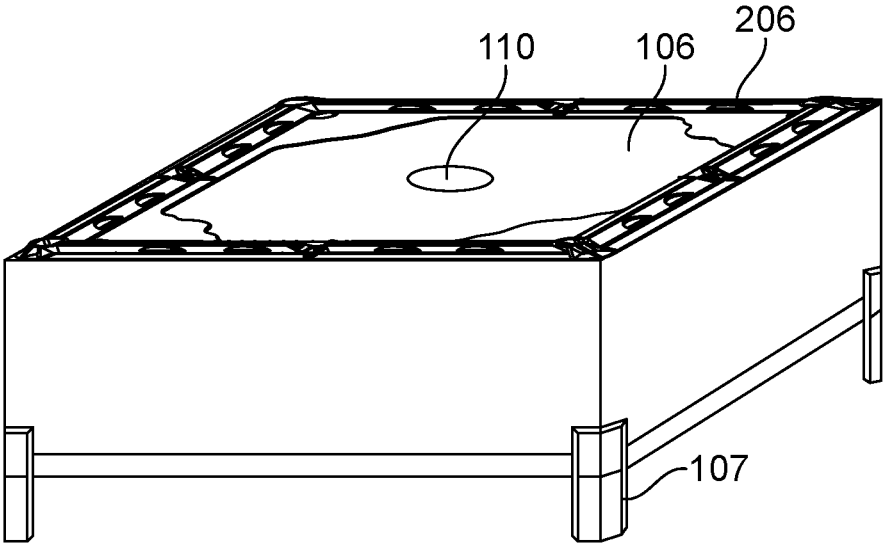
FIG. 18C illustrates a perspective view of the filler incorporated with the exhaust hole in the volumetric filling element, and external holder and spacer.

Referring to FIG. 18A, side view of the filler 100 incorporated with the volumetric filling element 106, steel, plastic, wooden or polymeric surrounding holder 107 attached on the bottom portion of the volumetric filling elements 106 is illustrated. Referring to FIG. 18B, side view of the filler 100 incorporated without the keeper tray (102 or 104) is illustrated. Referring to FIG. 18C, perspective view of the filler 100 incorporated with an exhaust hole 110 in the volumetric filling element 106, and external spacers 206 attached on the top portion of the volumetric filling element 106, is illustrated.

Figure 19A:
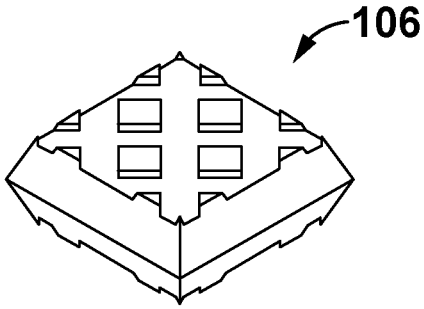
FIG. 19A-FIG. 19P illustrate a perspective view of various shape and configuration of the volumetric filling element according to an embodiment.
Figure 19B:
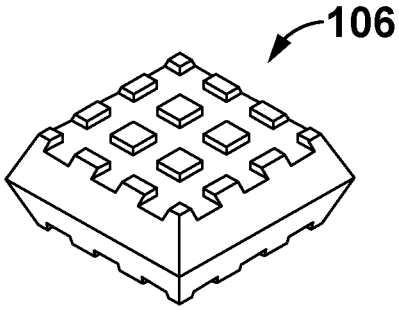
Figure 19C:
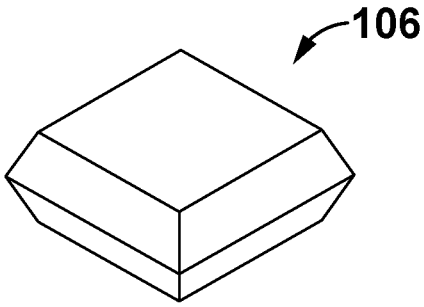
Figure 19D:
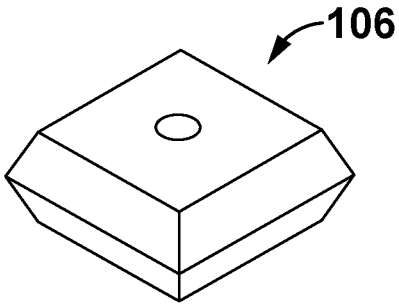
Figure 19E:
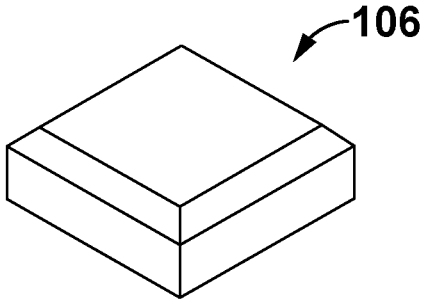
Figure 19F:
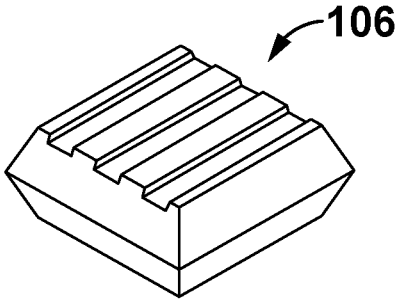
Figure 19G:
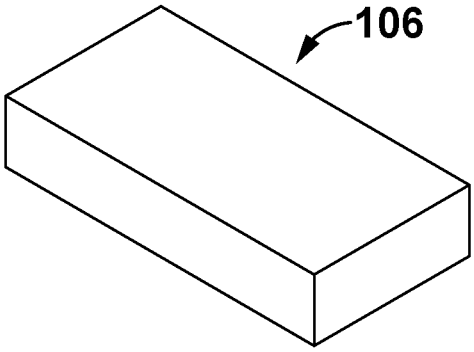
Figure 19H:
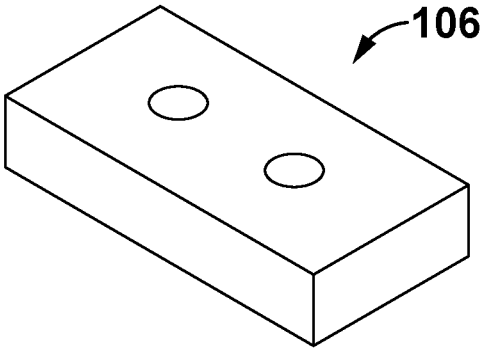
Figure 19I:
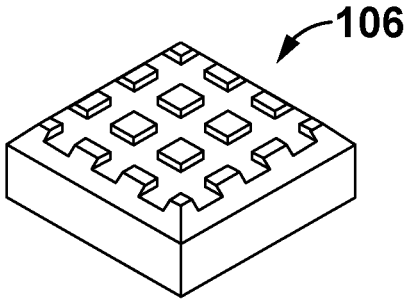
Figure 19J:
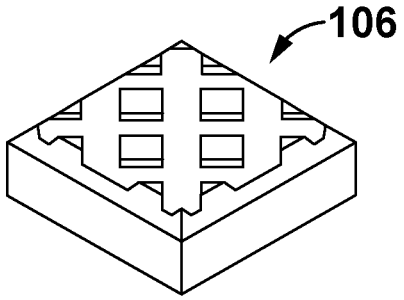
Figure 19K:
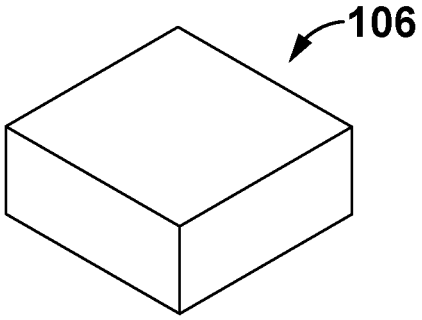
Figure 19L:
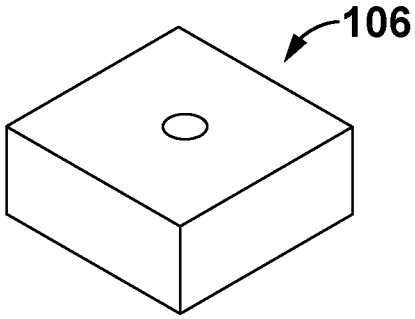
Figure 19M:
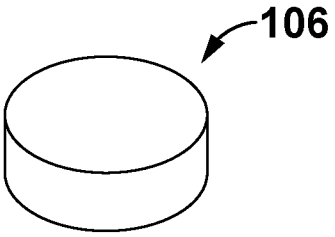
Figure 19N:
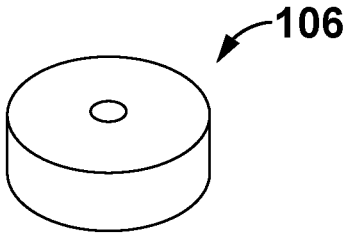
Figure 19O:
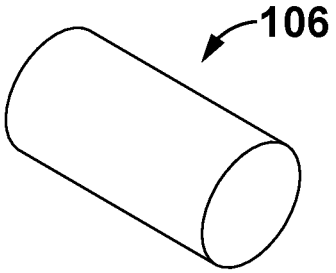
Figure 19P:
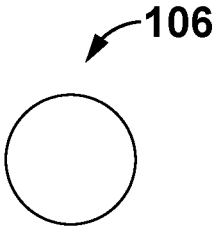

Referring to FIG. 19A-FIG. 19P, perspective view of various shape and configuration of the volumetric filling element 106 are illustrated. The volumetric filling element 106 is a high-density material with embodied spacer shaped configuration, where the filler 100 for use in a two-way concrete slab is incorporated without upper keeper tray 102 and lower keeper tray 104. The spacer shaped configuration embodied on the high-density filler 100 performs similar to the keeper tray (102 or 104) to provide sufficient space between the rebar 204 and filler 100 and perform as a stand or keeper tray under the filler 100 to seat on the rebar 204.

Figure 22A:
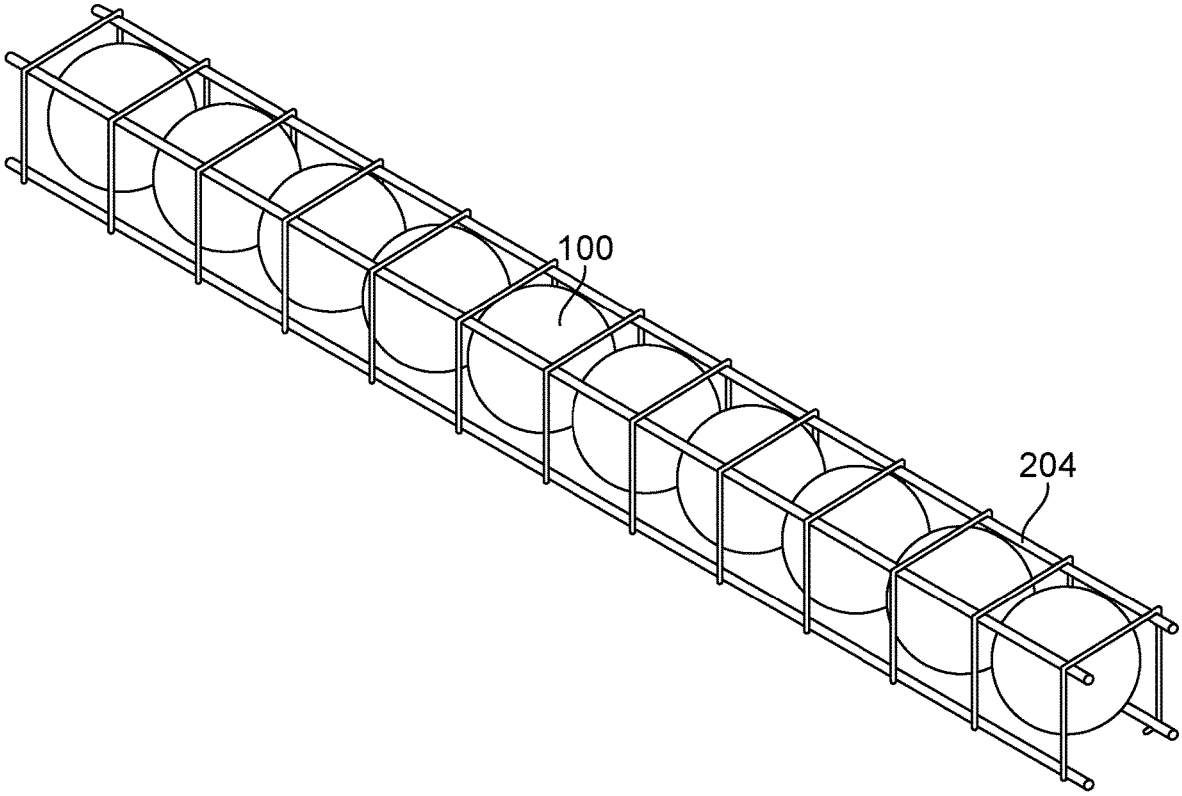
FIG. 22A-FIG. 22C illustrate a top perspective view of various shape and configuration of the rebar assembled on the volumetric filling element according to an embodiment.
Figure 22B:
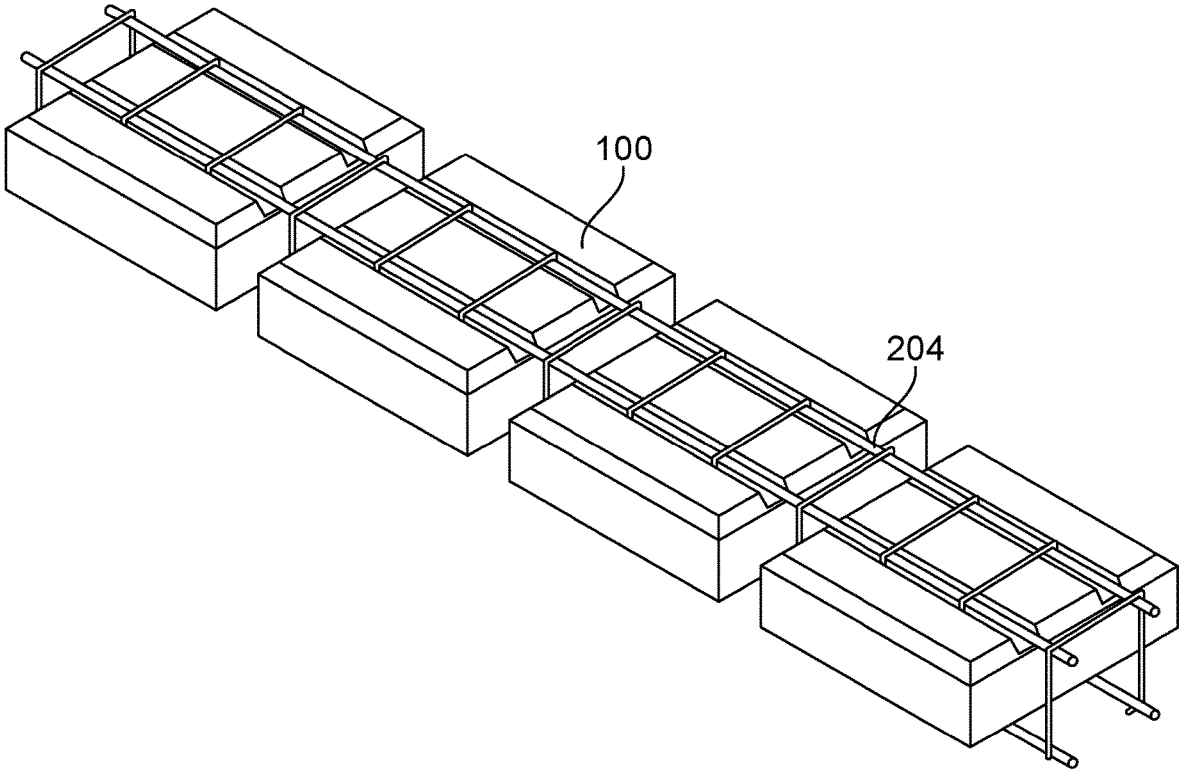
Figure 22C:
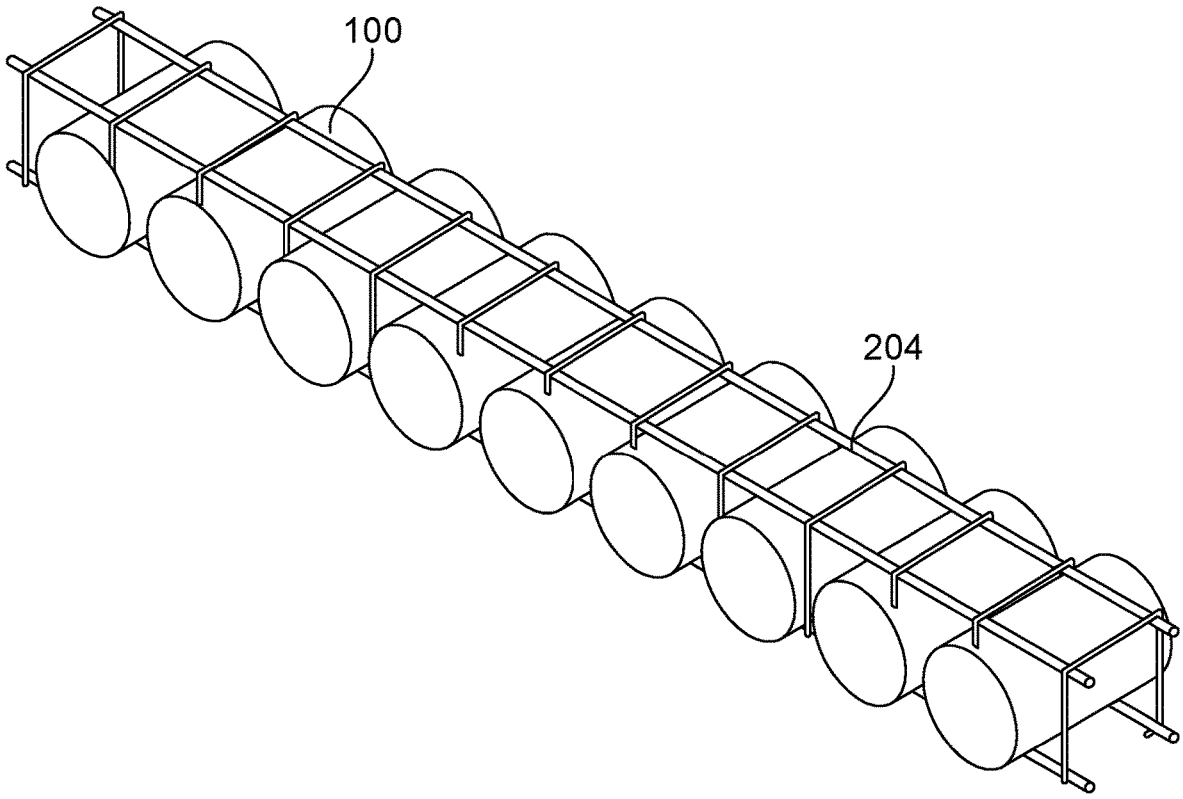
Figure 23A:
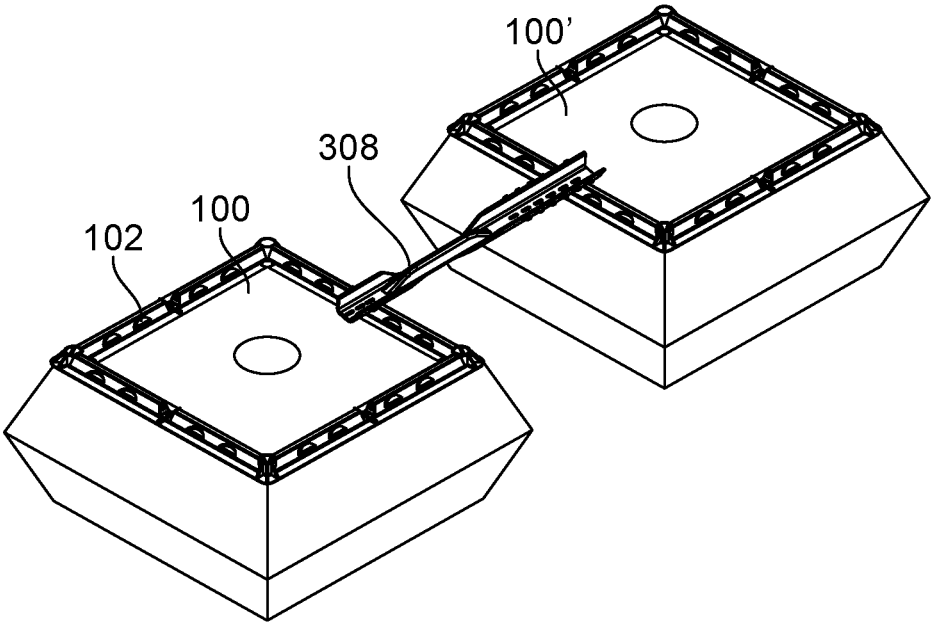
FIG. 23A and FIG. 23B illustrate a top perspective view on various shape and configuration of the belt assembled on the upper keeper tray of the fillers according to an embodiment.
Figure 23B:
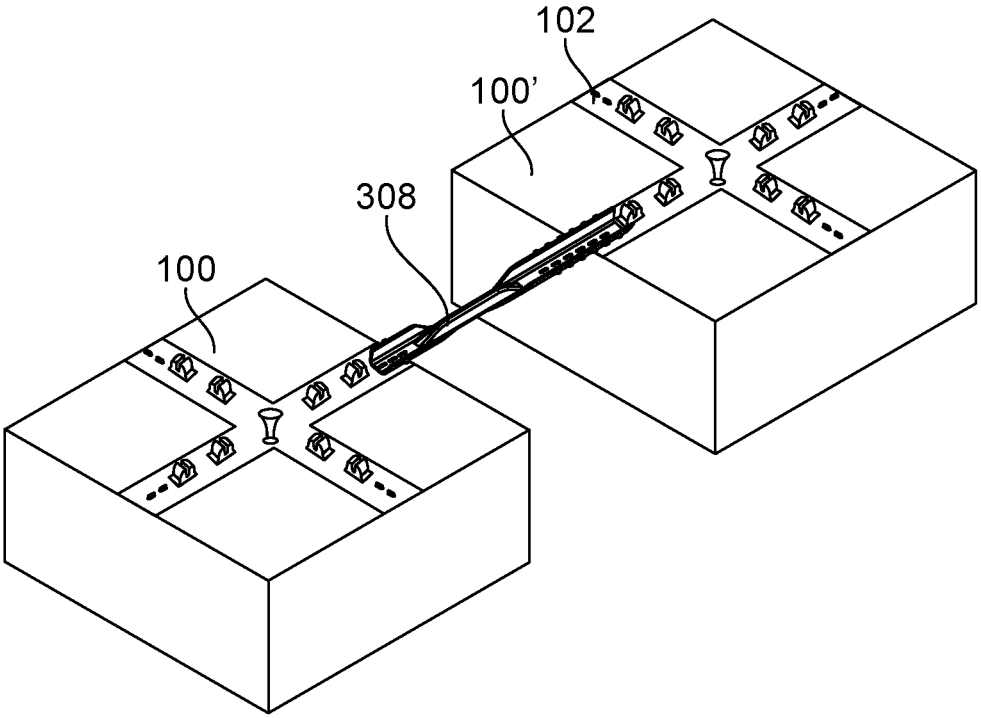
Figure 24A:
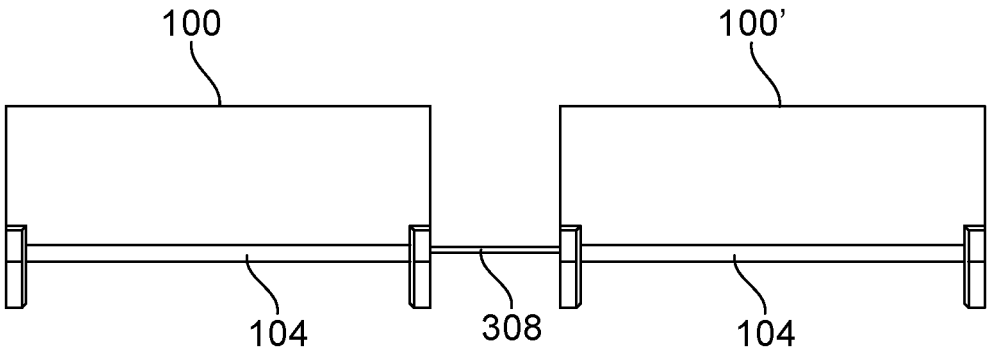
FIG. 24A and FIG. 24B illustrate a side view and side perspective view of the belt assembled on the holder according to an embodiment.
Figure 24B:
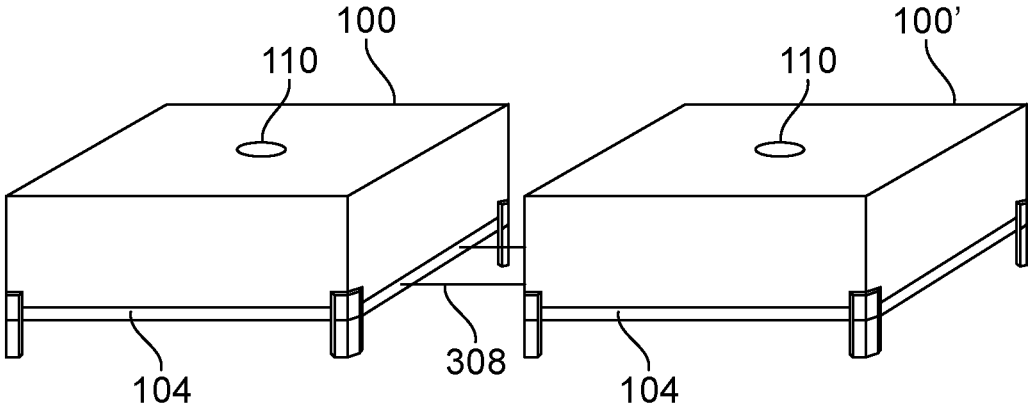
Figure 25A:
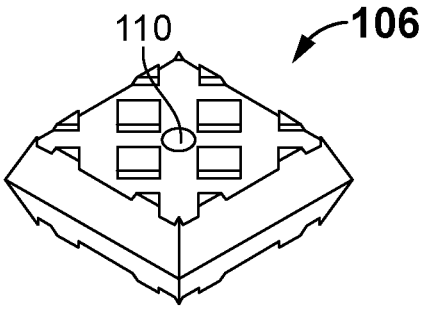
FIG. 25A-FIG. 25G illustrate holes on the different shapes of the volumetric filling element according to an embodiment.
Figure 25B:
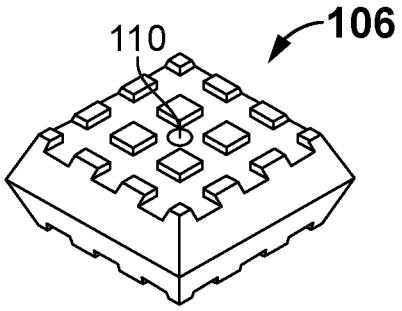
Figure 25C:
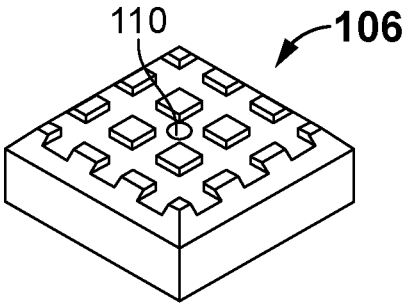
Figure 25D:
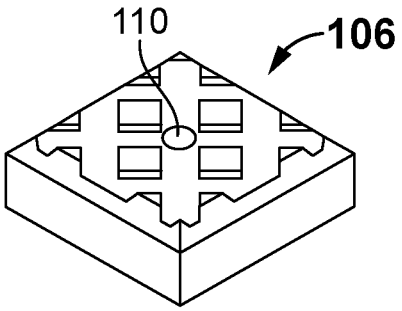
Figure 25E:
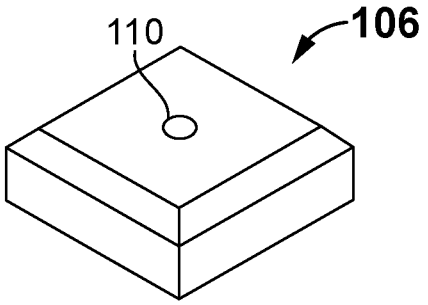
Figure 25F:
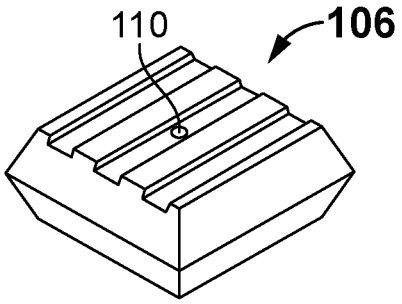
Figure 25G:
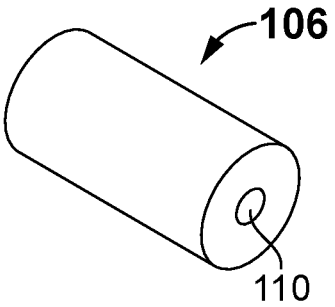

Referring to FIG. 22A-FIG. 22C, top perspective view of various shape and configuration of the rebar 204 assembled on the fillers 100 are illustrated. In one embodiment, the rebar 204 is configured to assemble based on different configuration of the holder 107. Referring to FIG. 23A and FIG. 23B, top perspective view on various shape and configuration of the belt 308 assembled on the upper keeper tray 102 of one filler 100 to the adjacent filler 100' are illustrated. Referring to FIG. 24A and FIG. 24B, side view and side perspective view of the belt 308 assembled on the holder 107 of one filler 100 to the adjacent filler 100' with exhaust hole 110 are illustrated. In some embodiments, the belt 308 is made of different shape and configuration.

Referring to FIG. 25A-FIG. 25G, one or more holes 110 on different shapes of the volumetric filling element 106 are illustrated. In an embodiment, the volumetric filling element 106 further includes one or more exhaust holes 110. Usually, the exhaust holes 110 embedded in the center of filler 100. In some embodiments, the exhaust holes 110 could be of various sizes, but it is necessary to have enough diameter for vibrator ingression. One key benefit of the volumetric filling element 106 is the ability of size optimization proportional to loads and span. In other words, the optimized size of elements depends on amount and effective span of an applied load. In some embodiments, the volumetric filling element 106 is variable size from 65×65 cm to 45×45 cm. The exhaust holes 110 passing through the element 106 from a bottom to a top of the volumetric filling element 106 is utilized in large size elements such as 60×60 cm, to exit the bottom surface trapped air and bring the vibrator to the center of the lower concrete slab. Further, the exhaust hole 110 in large volumetric filling element 106 prevents honeycombing in the lower concrete slab.

Figure 26:
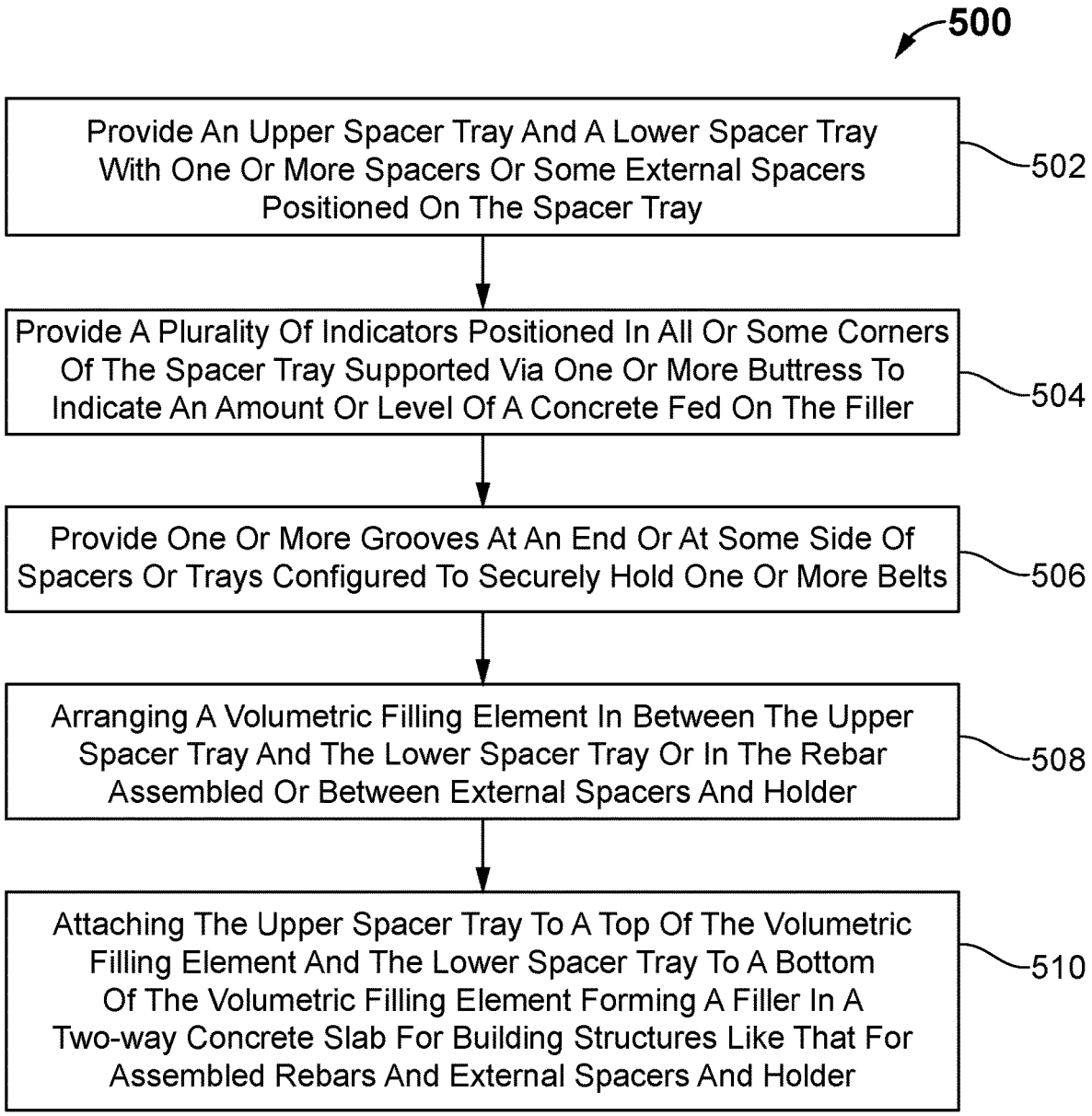
FIG. 26 illustrate a method for implementing fillers in a two-way concrete slab for building structures.

Referring to FIG. 26, a method 500 for implementing fillers 100 (as described in above paragraphs and figures) in a two-way concrete slab for building structures is disclosed, according to an embodiment. In step 502, the method 500 comprises providing an upper keeper tray and a lower keeper tray with one or more spacers, or some external spacers positioned on the keeper tray. In step 504, the method 500 comprises providing a plurality of indicators positioned in all corners or at least one corner of the keeper tray supported via one or more buttress to indicate an amount or level of a concrete fed on the filler.

In step 506, the method 500 further includes providing one or more grooves at an end or at some side of the spacers or trays, configured to securely hold one or more belts. The spacer and belt in the keeper tray is configured to receive one or more rebar, said at least one belt is configured to attach at least one upper keeper tray, lower keeper tray, or both. In step 508, the method 500 further includes arranging a volumetric filling element in between the upper keeper tray and the lower keeper tray or in the rebar assembled or between external spacers and holder. In step 510, the method 500 comprises attaching the upper keeper tray to a top of the volumetric filling element and the lower keeper tray to a bottom of the volumetric filling element, thereby forming a filler in a two-way concrete slab for building structures like that for assembled rebars and external spacers and holder.

In one embodiment, the method 500 includes implementation of different configuration and designs of filler with holder, external spacer, high density fillers or caged filler. In another embodiment, the method 500 is also implemented with the spacer, which is a continuous fabric spacer. The volumetric filling element is a high-density material with embodied spacer, where the filler for use in a two-way concrete slab is incorporated without upper keeper tray and lower keeper tray. In another word, the spacer embodied on the high-density filler performs similar to the keeper tray to provide sufficient space between the rebar and filler and perform as a stand under the filler to seat on the rebar.

One aspect of the present disclosure is directed to a filler for use in a two-way concrete slab for building structures. The filler comprises an upper keeper tray and a lower keeper tray with one or more spacers positioned on said keeper tray; and a plurality of indicators positioned in all corners or at least one corner or in center of the keeper tray supported via one or more buttress to indicate an amount or level of a concrete fed on the filler. The filler may further comprise one or more grooves at an end of the spacer, configured to securely hold one or more belts, wherein the spacer and belt in the keeper tray is configured to receive one or more rebar, said at least one belt is configured to attach at least one upper keeper tray, lower keeper tray, or both. Moreover, the filler further may comprise a volumetric filling element arranged in between the upper keeper tray and the lower keeper tray, wherein the upper keeper tray is attached to a top of the volumetric filling element and the lower keeper tray is attached to a bottom of the volumetric filling element.

The volumetric filling element may be of a high-density material, such that the said volumetric filling material may be incorporated without upper keeper tray and lower keeper tray. The volumetric filling element may be made of a light-weight material, and the volumetric filling element is carved to enable adjustable geometrical structure and size of the filler. The light-weight material may be made from polystyrene, polyurethane, polyethylene, concrete foam clay, gas concrete, autoclaved aerated concrete (AAC), or any combination thereof. The light-weight material may be a sound insulator, heat insulator, or both.

The volumetric filling element may be a cubic-shaped element with one or more chamfer edges. The cubic-shaped element with one or more chamfer edges enables haunch connection in a junction between a web and a flange. This haunch connection may be configured to increase section modulus of one or more joists formed between the volumetric filling elements. The haunch connection may further be configured to reduce stress concentration in the junction between the web and flange. The joist may comprise one or more stirrups and steel wires, with the stirrups and steel wires fastening to the upper keeper tray and the lower keeper tray to encompass the volumetric filling element to resist buoyancy force of the feeding concrete.

The upper keeper tray and the lower keeper tray are fastened or welded via one or more stirrups to a rebar. The rebar may be configured to form coop or hutch around the volumetric filling element, and/or to resist shear force and movements on the concrete slab. The upper keeper tray and lower keeper tray may be made of plastic, wood or steel. The volumetric filling element may be one of geometric shape including cube, cylinder, sphere, truncated pyramid and combination thereof. The keeper tray may be configured to distribute load on the volumetric filling element. The keeper tray may be further configured to securely hold the volumetric filling element. The keeper tray, in one example, may comprise one or more ridges. The filler may further comprise one or more spacers positioned around the keeper tray.

The filler may further comprise one or more grooves at an end of the spacer, configured to securely hold one or more belts. The belt may be configured to connect a filler to an adjacent filler of the concrete slab, and support at least partial load exerted by the rebar of the concrete slab. The belt may be configured to securely hold both upper keeper tray and lower keeper tray of all the volumetric filling elements via a fastening means. The belt may be incorporated on the keeper tray depends on shape and location of the keeper tray and belt, and number of ridges and grooves in the keeper tray and belt. The belt may be configured to limit one or more movement of at least two volumetric filling elements. In an example, the belt may be further configured to position the rebar between the volumetric filling elements.

The indicator may be configured to indicate thickness of the concrete fed on the voided volumetric filling element.

The indicator may be positioned on the upper keeper tray to indicate the status of concrete thickness fed on the voided volumetric filling element. The installable legs with predetermined length mounted on the lower keeper tray to allow concrete to reach under the lower keeper tray while feeding the concrete. In an example, the at least one keeper tray further may comprise one or more nail-shaped appendices. These nail-shaped appendices may be configured to attach at least one keeper tray to the volumetric filling element via an adhesive. The belt may comprise one or more linear grooves, and/or one or more additional ridges on a wall of the belt to lock the grooves in the keeper tray. The belt may be configured to connect one or more fillers. The spacer may be a continuous fabric spacer. The volumetric filling element may further include one or more exhaust holes to allow exit of the trapped air.

Another aspect of the present disclosure is directed to a filler for use in a two-way concrete slab for building structures, bridges and foundation. The filler comprises an upper keeper tray and a lower keeper tray; and a volumetric filling element arranged in between the upper keeper tray and the lower keeper tray, wherein the upper keeper tray is attached to a top of the volumetric filling element and the lower keeper tray is attached to a bottom of the volumetric filling element. The volumetric filling element may be made of a light-weight material, and be carved to enable adjustable geometrical structure and size of the filler. In another example, the filler may comprise a plurality of volumetric filling element, wherein the volumetric filling element is a high-density material and embodied with a continuous fabric spacer, and such that the volumetric filling element is incorporated without the upper keeper tray and the lower keeper tray.

Another aspect of the present disclosure is directed to a method 500 for implementing fillers in a two-way concrete slab for building structures. The method 500 comprises providing an upper keeper tray and a lower keeper tray with one or more spacers positioned on the keeper tray; and providing a plurality of indicators positioned in all corners or at least one corner of the keeper tray supported via one or more buttress to indicate an amount or level of a concrete fed on the filler. The method 500 further may comprise providing one or more grooves at an end of the spacer, configured to securely hold one or more belts, wherein the spacer and belt in the keeper tray is configured to receive one or more rebar, said at least one belt is configured to attach at least one upper keeper tray, lower keeper tray, or both. Moreover, the method 500 may further comprise arranging a volumetric filling element in between the upper keeper tray and the lower keeper tray, and attaching the upper keeper tray to a top of the volumetric filling element and the lower keeper tray to a bottom of the volumetric filling element, thereby forming a filler in a two-way concrete slab for building structures.

In one example, the volumetric filling element is a high-density material, wherein the said volumetric filling material is incorporated without upper keeper tray and lower keeper tray. The light-weight material may be selected from a group comprising any one of polystyrene, polyurethane, polyethylene, concrete foam clay, gas concrete, autoclaved aerated concrete (AAC), or any combination thereof. The cubic-shaped element with one or more chamfer edges enables haunch connection in a junction between a web and a flange. The haunch connection may be configured to increase section modulus of one or more joists formed between the volumetric filling elements. The haunch connection may further be configured to reduce stress concentration in the junction between web and flange. The joist may comprise one or more stirrups and steel wires, wherein said stirrups and steel wires fastens the upper keeper tray and the lower keeper tray to encompass the volumetric filling element to resist buoyancy force of the feeding concrete.

The incorporation of the belt on the keeper tray may depend on shape and location of the keeper tray and belt, and number of ridges and grooves in the keeper tray and belt, and the belt may be configured to limit one or more movement of at least two volumetric filling elements, and further wherein the belt is further configured to position the rebar between the volumetric filling elements. The indicator may be configured to indicate the thickness of the concrete fed on the voided volumetric filling element, and the indicator may be positioned on the upper keeper tray to indicate the status of concrete thickness fed on the voided volumetric filling element.

In one embodiment, at least one of upper keeper tray and lower keeper tray comprises an external plate spacer configured to attach the filler and reinforce the filler against fracture, punching, tumbling and rupture. The filler is attached to the external plate spacer by a compatible glue and nail shaped appendixes. Although many types of glue exist, Applicants surprisingly found that one combination of a number of components provided the best results, above and well beyond that of the individual components. In particular, Applicants surprisingly found that a combination of DM5 glue with water and wallpaper adhesive powder allowed for highly desirable results How to find the correct glue type and functionality became a certain feature of this invention. Applicants experimented with many different types of glue and found the results to be something that could be improved upon.

To this end, Applicants began experimenting with many different components added into certain glues and glue combinations in order to discover the exact combination that would provide for superior results. Applicants discovered that a combination of DM5 glue with water and wallpaper adhesive powder was able to surprisingly give well above expected results. In particular, although DM5 glue and wallpaper adhesive powder alone were tested and provided for some benefit, it was not expected that this combination with water would vastly be better than the function of the individual components. For example, other combinations of glues and components, all of which alone had some effect, did not increase the functionality of the combination to be well above the components alone and to the same extent as Applicants discovered combination of DM5 glue with water and wallpaper adhesive powder. The discovery of this particular combination at this particular ratio of mixes of the components is yet another feature of the present invention.

The filler can be attached to the external plate spacer by a compatible glue and/or nail shaped appendixes. In one example, the filler is attached to the external plate spacer using a combination of DM5 glue with water and wallpaper adhesive powder. The filler may be attached to the external plate spacer using a combination of DM5 glue with water and wallpaper adhesive powder at a ratio of 48% Water, 47% DM5 and 5% wallpaper adhesive powder. This exact ratio of these three components was surprisingly found to provide superior functional qualities with the advantage of it being more economical and practical. Interestingly, the same three components mixed at different ratios provided less than optimal results. Applicants were first able to discover this particular combination of three elements that would provide for great functional quality at low cost and moreover it was discovered that the particular ratio of about 47% DM5, about 48% Water, and about 5% wallpaper adhesive powder was, in one embodiment, a feature of the present invention.

The glue and component combinations that were tested include wood glue, wood glue and water, DM5 glue, DM5 glue and water, wallpaper adhesive powder and water, combination of DM5 glue, water, and wallpaper adhesive powder, all-purpose adhesives that are solvent free and water based, two-component adhesives, and instant glues. The characteristics of different types/mixtures of glues are shown in Table 1. Based on the characteristics of the filler or external plate spacer, particular type/mixture of the glue is used.

In one example, the discovered combination of DM5 glue with water and wallpaper adhesive powder at a particular ratio was used and it gave well above expected results and allowed for highly desirable and improved functionality.

TABLE 1

Characteristics of Different Mixture of Glues Used for Attaching Filler to the External Plate Spacer

| Type | Commercial Name | Water Resistance | Adhesion | Slip Rate | Sprayability | Poly Styrene Corrosion | Practical Grade (higher the better) | Cost (1-5) (the lower, the more economical) |
|---|---|---|---|---|---|---|---|---|
| Wood Glue | Polyvinyl Acetate (PVA) | Good | Good | Low | Low | No | 6 | 3 |
| Wood Glue + Water | Polyvinyl Acetate (PVA) | Good | Low | High | High | No | 5 | 1 |
| DM5 glue | Acrylic Emulsion Primer | High | High | Low | Moderate | No | 8 | 4 |
| DM5 glue + Water | Acrylic Emulsion Primer | High | Low | High | High | No | 3 | 1 |
| Wallpaper Adhesive Powder + Water | Methyl Cellulose | Low | Low | Low | Low | No | 4 | 1 |
| DM5 glue + Water + Wallpaper Adhesive Powder | Acrylic Emulsion Primer + Methyl Cellulose | High | High | Low | High | No | 10 | 1 |
| All Purpose Adhesive | | Low | Low | Good | Good | No | 5 | 5 |
| Two-Component Adhesives | | | | | | Yes | 0 | 5 |
| Instant Glues | Cyanoacrylates | | | | | Yes | 0 | 5 |

The ratio of 50% water plus 50% DM5 was found to not be practical and applicable. Meanwhile, 100% from DM5 glue has the limitation of being very expensive and cost prohibitive. Moreover, although DM5 may be a strong glue with good water resistance, it was shown to be highly inferior if used by itself on plastic surfaces for example. The inventors were able to experiment and discover that mixing a certain amount of a certain powder into the DM5 can vastly improve, with water added, the overall function for this particular purpose.

Another combination that was experimented and shown not to be effective is the combination of wood glue with water, however, limitations of this combination included the fact that the glue would dissolve in the water and this would cause problems in the rain. The discovered combination is highlighted in the table above. Of all the combinations and ratios tested, it was discovered that the combination of 48% water, 47% DM5 and 5% wallpaper adhesive powder is both practically, applicable and economical. This combination at this particular ratio was shown to be the most desired glue for the purpose of this invention. Indeed, in one example, this is one feature of the present invention. This is reflected in the practical grade as given in the table above, this grade being a combination of the levels of five different features as shown.

The method 500 further may include embedding one or more holes in the length of the surrounded spacer for concrete entry in order to prevent the creation of hollow spaces under surrounding spacer and to prevent the weakening of the top slab. These one or more holes may be configured to allow the entry of concrete under the spacers that are on the trays, such that any space or void that is under the spacer is filled with concrete and air pockets underneath the spacer are minimized, thereby improving strength and integrity. The method 500 further may comprise embedding one or more holes on the spacers, wherein said holes are configured to allow the entry of concrete through the holes to under the spacers that are on the trays, such that voids or air pockets under the spacers are generally filled with concrete, thereby improving strength and integrity.

In one example, the fillers and external plate spacers can be protected and attached by packing with shrinking flexible nylon or stretch film. This has the benefit of protecting the fillers and external plate spacers from physical handling and overall damage, including for example scratches or divots being made or segments falling off. It can be an extra protective method, and it can be used with or without the glue in one example.

In one aspect, the disclosure is directed to a filler for substituting a part of concrete in a two-way concrete slab when build a structure. The fillers comprising a top keeper tray and a underside keeper tray; and a volumetric filling element made of a light-weight material, wherein the volumetric filling element is arranged in between the top keeper tray and the underside keeper tray, and wherein the top keeper tray is attached to a top of the volumetric filling element and the underside keeper tray is attached to a bottom of the volumetric filling element.

A cutting of the light-weight material of the volumetric filling element enables adjusting a geometry of the volumetric filling element and thereby enables adjusting a geometry of the filler. The volumetric filling element may be a cubic-shaped element with chamfer edges. The top keeper tray may comprise an indicator for indicating a thinness of a concrete poured on the filler. The at least one of the top keeper tray and the underside keeper tray may be made of plastic. The at least one of the top keeper tray and the underside keeper tray may comprise a plurality of nail-shape appendices for attaching to the at least one keeper tray to the filler.

In one example, at least one of the top keeper tray and the underside keeper tray is glued to the filler. In another example, the at least one of the top keeper tray and the underside keeper tray is made of the light-weight material, and wherein the at least one of the keeper tray and the volumetric filling element forms a continuous fabric. The volumetric filling element may comprise one or more exhaust holes passing through the element from a bottom to a top the element for allowing an exit of trapped air from a top of the element during concrete pouring. The filler may comprise a plurality of legs mounted below the underside keeper tray for allowing concrete to reach under the underside keeper tray during concrete pouring. The filler may further comprise at least one connection belt attached to at one of the top keeper tray and the underside keeper tray, the connection belt being arranged and configured for connecting the filler to an adjacent filler of the concrete slab; and at least partially bearing a load exerted by a rebar of the concrete slab.

In one aspect, the disclosure is directed to a method 500 of producing a filler for substituting a part of concrete in a two-way concrete slab when build a structure, comprising: providing an top keeper tray and a underside keeper tray; providing a volumetric filling element made of a light-weight material, arranging the volumetric filling element in between the top keeper tray and the underside keeper tray, and attaching the top keeper tray to a top of the volumetric filling element and the underside keeper tray to a bottom of the volumetric filling element.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method.

Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein. While the above is a complete description of the preferred embodiments of the invention, various alternatives, modifications, and equivalents may be used. Therefore, the above description and the examples should not be taken as limiting the scope of the invention, which is defined by the appended claims.

What is claimed is:

1. A method for implementing fillers in a two-way concrete slab for building structures, the method comprising:

providing an upper keeper tray and a lower keeper tray with one or more spacers positioned on the keeper tray;

providing a plurality of indicators positioned in all corners or at least one corner of the keeper tray, supported via one or more buttress to indicate an amount or level of a concrete fed on the filler;

providing one or more grooves at an end of the spacer, configured to securely hold one or more belts, wherein the spacer and belt in the keeper tray is configured to receive one or more rebar, said at least one belt is configured to attach at least one upper keeper tray, lower keeper tray, or both;

arranging a volumetric filling element in between the upper keeper tray and the lower keeper tray, and attaching the upper keeper tray to a top of the volumetric filling element and the lower keeper tray to a bottom of the volumetric filling element, thereby forming a filler in a two-way concrete slab for building structures.

2. The method of claim 1, wherein the volumetric filling element is a high-density material, wherein the said volumetric filling material is incorporated without upper keeper tray and lower keeper tray.

3. The method of claim 1, wherein the volumetric filling element is made of a light-weight material, wherein the volumetric filling element is carved to enable adjustable geometrical structure and size of the filler.

4. The method of claim 3, wherein the light-weight material is selected from a group comprising any one of polystyrene, polyurethane, polyethylene, concrete foam clay, gas concrete, autoclaved aerated concrete (AAC), or any combination thereof.

5. The method of claim 1, wherein the keeper tray is configured to distribute load on the volumetric filling element.

6. The method of claim 1, wherein the keeper tray is further configured to securely hold the volumetric filling element.

7. The method of claim 1, wherein the keeper tray comprises one or more ridges, and wherein the belt is configured to connect a filler to an adjacent filler of the concrete slab, and support at least partial load exerted by the rebar of the concrete slab.

8. The method of claim 1, wherein the belt is configured to securely hold both upper keeper tray and lower keeper tray of all the volumetric filling element via a fastening means.

9. The method of claim 1, wherein the incorporation of the belt on the keeper tray depends on shape and location of the keeper tray and belt, and number of ridges and grooves in the keeper tray and belt, and wherein the belt is configured to limit one or more movement of at least two volumetric filling elements, and further wherein the belt is further configured to position the rebar between the volumetric filling elements.

10. The method of claim 1, wherein the indicator is configured to indicate thickness of the concrete fed on the voided volumetric filling element, wherein the indicator is positioned on the upper keeper tray to indicate the status of concrete thickness fed on the voided volumetric filling element.

11. The method of claim 1, wherein the indicator is a plurality of installable legs with pre-determined length mounted below the lower keeper tray to allow concrete to reach under the lower keeper tray while feeding the concrete.

12. The method of claim 1, wherein the belt comprises one or more additional ridges on a wall of the belt to lock the grooves in the keeper tray.

13. The method of claim 1, wherein the spacer is a continuous fabric spacer.

14. The method of claim 1, wherein at least one of upper keeper tray and lower keeper tray comprises an external plate spacer configured to attach the filler and reinforce the filler against fracture, punching, tumbling and rupture.

15. The method of claim 14, wherein the filler is attached to the external plate spacer by a compatible glue and nail shaped appendixes.

16. The method of claim 14, wherein the fillers and external plate spacers are protected and attached by packing with shrinking flexible nylon or stretch film.

17. The method of claim 14, wherein the filler is attached to the external plate spacer using a combination of DM5 glue with water and wallpaper adhesive powder at a ratio of 48% Water, 47% DM5 and 5% wallpaper adhesive powder and/or nail shaped appendixes.

18. The method of claim 1, further includes embedding one or more holes in length of the surrounded spacer for concrete entry to prevent weakening of the top slab compression area.

19. The method of claim 1, further comprising embedding one or more holes on the spacers, wherein said holes are configured to allow the entry of concrete through the holes to under the spacers that are on the trays, such that voids or air pockets under the spacers are generally filled with concrete, thereby improving strength and integrity.

* * * * *